US006305794B1

(12) United States Patent
Sasaki et al.

(10) Patent No.: US 6,305,794 B1
(45) **Date of Patent: *Oct. 23, 2001**

(54) LIQUID CONTAINER, INK JET CARTRIDGE HAVING SAME AND MANUFACTURING METHOD OF THE CONTAINER

(75) Inventors: Toshiaki Sasaki, Irvine, CA (US); Hidehisa Matsumoto, Kawasaki; Hiroaki Mihara, Musashino, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/904,571

(22) Filed: Aug. 4, 1997

(30) Foreign Application Priority Data

| | | |
|---|---|---|
| Aug. 2, 1996 | (JP) | 8-20446 |
| Aug. 2, 1996 | (JP) | 8-204645 |
| Sep. 24, 1996 | (JP) | 8-251631 |

(51) Int. Cl.[7] ..... B41J 2/175
(52) U.S. Cl. ..... 347/86
(58) Field of Search ..... 347/85, 86, 87; 220/495.01, 23.91, 62.21, 666, 669

(56) References Cited

U.S. PATENT DOCUMENTS

| | | | | |
|---|---|---|---|---|
| 4,509,062 | | 4/1985 | Low et al. | 347/87 |
| 5,040,001 | | 8/1991 | Dunn et al. | 347/86 |
| 5,435,452 | * | 7/1995 | Nishigami et al. | 215/12.1 |
| 5,552,816 | * | 9/1996 | Oda et al. | 347/86 |
| 5,975,330 | * | 11/1999 | Sasaki et al. | 220/495.01 |

FOREIGN PATENT DOCUMENTS

| | | |
|---|---|---|
| 493978 | 7/1992 | (EP) . |
| 560398 | 9/1993 | (EP) . |
| 738605 | 10/1996 | (EP) . |
| 748692 | 12/1996 | (EP) . |
| 56-67269 | 6/1981 | (JP) . |
| 59-204566 | 11/1984 | (JP) . |
| 61-93246 | 5/1986 | (JP) . |
| 63-12427 | 1/1988 | (JP) . |
| 4-267727 | 9/1992 | (JP) . |
| 4-339759 | 11/1992 | (JP) . |
| 5-77345 | 3/1993 | (JP) . |
| 5-213372 | 8/1993 | (JP) . |
| 5-213373 | 8/1993 | (JP) . |
| 5-254144 | 10/1993 | (JP) . |
| 6-13099 | 1/1994 | (JP) . |
| 6-27523 | 2/1994 | (JP) . |
| 6-211243 | 8/1994 | (JP) . |
| 6-226993 | 8/1994 | (JP) . |
| 7-304187 | 11/1995 | (JP) . |
| 91/07240 | 5/1991 | (WO) . |

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

A liquid container includes a generally prism-like casing having a substantial air vent and having a corner portion formed by extensions of three sides of the prism configuration; an inner shell for containing liquid therein, the inner shell having outside equivalent or similar to inside of the casing; a liquid supply portion for supplying the liquid to outside from the liquid containing portion; a pinch-off portion where the inner shell is pinched by the casing; an integral portion where a maximum area side of the inner shell is integral with a side of the inner shell opposite therefrom.

19 Claims, 29 Drawing Sheets

FIG. 14(a)
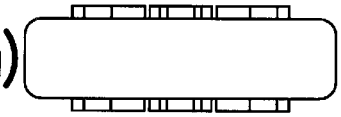
FIG. 14(b)
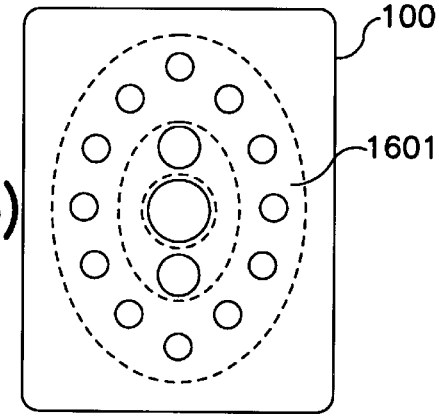
FIG. 14(c)
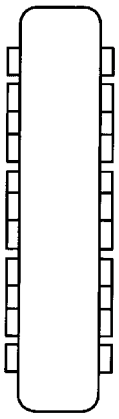
FIG. 14(d)
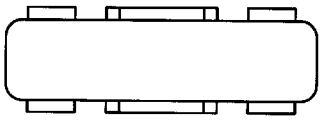
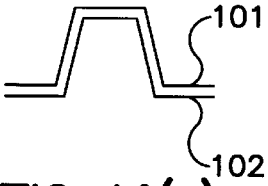
FIG. 14(g)
FIG. 14(e)
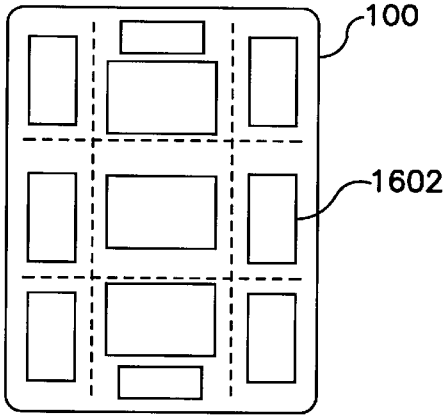
FIG. 14(f)
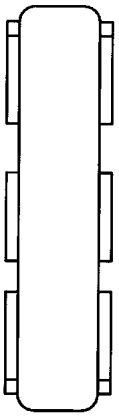
FIG. 14(h)
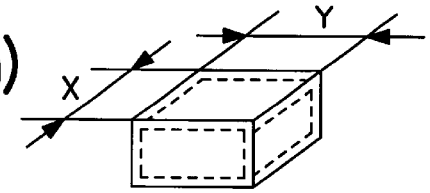
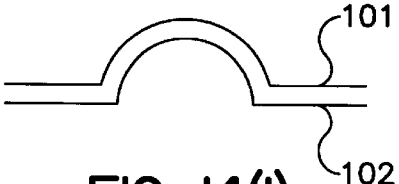
FIG. 14(i)

LIQUID CONTAINER, INK JET CARTRIDGE HAVING SAME AND MANUFACTURING METHOD OF THE CONTAINER

FIELD OF THE INVENTION AND RELATED ART

The present invention relates to a liquid container for supplying liquid to an external recording element such as pens and ink ejection portion which use negative pressure, an ink jet cartridge integrally having the container and an ink jet recording head, and a manufacturing method of the container.

A container for accommodating liquid is known wherein the liquid is supplied out of the container while maintaining a negative pressure within the container. Such a container performs appropriate liquid supply for the liquid using portion such as a nib or tip of a pen or recording head connected to the container, by the negative pressure produced by the container per se.

Various liquid accommodating containers of this type are used, but the usable ranges thereof are rather limited. One of the reasons for this is that there has not been a one which is easy to manufacture and which is a simple in structure. For example, in the field of the ink jet recording requiring a proper negative pressure property, a container having a sponge therein as a generation source for the negative pressure or a bladder-like container having a spring providing force against an inward deformation due to the consumption of the ink, as disclosed in Japanese Laid Open Patent Application No. SHO-56-67269, Japanese Laid Open Patent Application No. HEI-6-226993, for example. U.S. Pat. No. 4,509,062 discloses an ink accommodation portion of rubber having a conical configuration with a rounded top having a smaller thickness than the other portion. The round thinner portion of the circular cone portion provides a portion which displaces and deforms earlier than the other portion. These examples have been put into practice, and are satisfactory at present.

However, the negative pressure generating mechanisms described above is relatively expensive, and therefore, does not suit for the writing devices such as markers, plotters having writing tips. The use of the complicated negative pressure generating mechanism is not desirable since it result in bulkiness of the writing device. In writing devices, the use is made with a felt capable of generating a negative pressure and of introducing the air from the tip to permit supply of the ink thereto. The main problem of this type of the gas-liquid exchange structure for the ink supply is the ink leakage at the tip. In order to solve this problem, an ink retaining mechanism has been proposed wherein a great number of fins are formed at predetermined intervals between the tip and the liquid accommodating container extending in a direction perpendicular to the ink supply direction, for the purpose of preventing the ink leakage by retaining the ink which is going to leak upon the ambient condition change or the like. However, such a mechanism results in a relatively large amount of non-usable ink remaining in the container. The ink supplying system of such writing devices, generally uses an open type, which leads to evaporation of the ink, with the result of reduction of the usable amount of the ink. Therefore, ink evaporation suppression by using substantial sealed type is desirable.

The description will be made briefly about the substantially sealed type in the ink jet recording. When a negative pressure generation source is not used in an ink supplying system, the ink is supplied using the level difference relative to the ink using portion (ink ejection head), that is, the static head difference. This does not require any special condition in the ink accommodation portion, and therefore, a simple ink accommodation bladder is used in many cases.

However, In order to use a closed system, the ink supply path has to extend between the ink accommodation bladder to the ink using portion (ink ejection head) thereabove with the result that long ink supply tube is required, so that system is bulky. In order to reduce or eliminate the static head difference Of the ink supply path, an ink container capable of providing the ink ejection head with a negative pressure, has been proposed and put into practice. Here, a term "ink jet cartridge" is used to cover a unified head and ink container.

The ink jet cartridge is further classified into a type wherein the recording head and the ink accommodating portion are always unified, and a type wherein the recording means and the ink accommodating portion are separable, and are separately mountable to the recording device, but are unified in use.

In either structure, the connecting portion of the ink accommodating portion relative to the recording means is provided at a position lower than the center of the ink accommodating portion in order to increase the usage efficiency of ink accommodated in the ink accommodating portion. In order to stably maintain the ink and to prevent the ink leakage from the ejection portion such as a nozzle in the recording means, the ink accommodating portion in the ink jet cartridge is given a function of generating a back pressure against the ink flow to the recording means. The back pressure is called "negative pressure", since it provides negative pressure relative to the ambient pressure at the ejection outlet portion.

In order to produce the negative pressure, the use may be made with capillary force of a porous material or member. The ink container using the method, comprises a porous material such as a sponge contained and preferably compressed in the entirety of the ink container, and an air vent for introducing air thereinto to facilitate the ink supply during the printing.

However, when the porous material is used as an ink retaining member, the ink accommodation efficiency per unit volume is low. In order to provide a solution to this problem, the porous material is contained in only a part of the ink container rather than in the entirety of the ink container in a proposal. With such a structure, the ink accommodation efficiency and ink retaining performance per unit volume is larger than the structure having the porous material in the entirety of the ink container.

From the standpoint of improving the ink accommodation efficiency, the bladder-like container using or not using the spring, or the ink accommodating container of rubber is usable.

Such an ink container is widely used now. However, further improvement is desired.

SUMMARY OF THE INVENTION

Accordingly, it is a principal object of the present invention to further improve an ink accommodation efficiency.

It is a further object of the present invention to provide a container made of simple parts.

It is a further object of the present invention to provide a container which can be recycled.

According to an aspect of the present invention, there is provided a liquid container, comprising a generally prism-like casing having a substantial air vent and having a corner portion formed by extensions of three sides of the prism configuration; an inner shell for containing liquid therein, said inner shell having outside equivalent or similar to inside of said casing; a liquid supply portion for supplying the liquid to outside from said liquid containing portion; a pinch-off portion where said inner shell is pinched by said casing; an integral portion where a maximum area side of said inner shell is integral with a side of said inner shell opposite therefrom.

According to another aspect of the present invention, there is provided a liquid container, comprising: a generally prism-like casing having a substantial air vent and having a corner portion formed by extensions of three sides of the prism configuration; an inner shell for containing liquid therein, said inner shell having outside equivalent or similar to inside of said casing; a liquid supply portion for supplying the liquid to outside from said liquid containing portion; a pinch-off portion where said inner shell is pinched by said casing; wherein said casing and said inner shell have respective maximum area sides which do not have said liquid supply portion or said pinch-off portion; a deformation confinement member provided on said maximum area side of said inner shell except for a marginal portion thereof.

According to a further aspect of the present invention, there is provided a manufacturing method for a liquid container including a casing having a substantial air vent; an inner shell including an outer surface equivalent to an inner surface of the casing and a liquid containing portion for accommodating liquid; a liquid supply portion for supplying the liquid from the liquid containing portion to outside, wherein the liquid container has a polygonal cross-section; the method comprising the steps of: preparing a mold corresponding to an outer shape of the liquid container, a first parison for a cylindrical casing having a diameter smaller than that of the mold, a second parison for an inner shell; injecting air to expand the first and second parisons to the mold to mold the casing and inner shell of the liquid container, wherein the casing and the inner shell are separable and substantially similar in configuration to each other; wherein the second parison comprises a first layer for forming an inner wall and a second layer for a reinforcing member, wherein the first layer is supplied continuously in both of supply direction of the second parison and a direction orthogonal thereto, and the second layer is supplied intermittently in both of the directions.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 14 ((a)–(c) and (d)–(f)) is a top plan view, a top plan view and a side view of a device according to twelfth embodiment and a modified example, and, (g), (i) are sectional views of a projection formed on a liquid container, and (h) is a view of a liquid container.

DESCRIPTION OF THE PREFERRED EMBODIMENTS

Figure 1A:
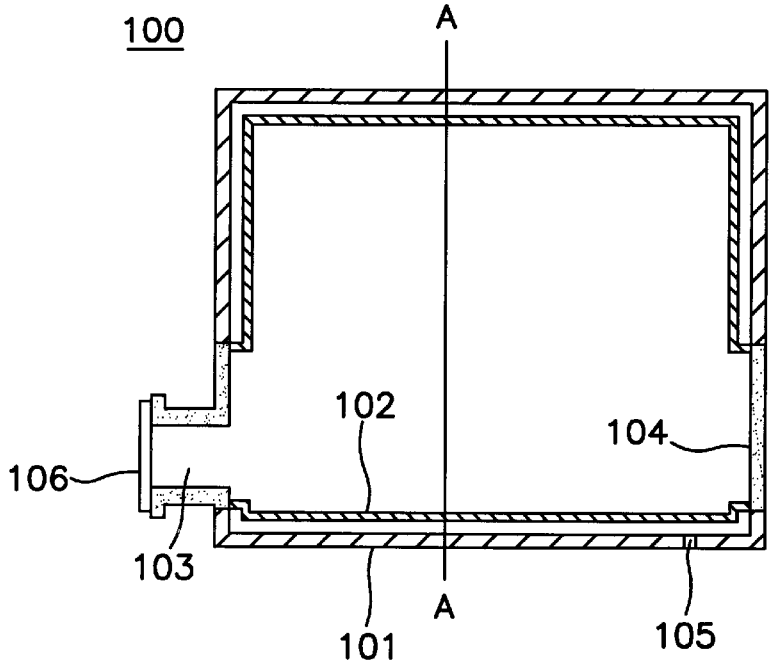
FIG. 1 is a schematic view of a liquid container according to an embodiment of the present invention, wherein (a) is a sectional view, (b) is a side view, (c) is a perspective view.
Figure 1B:
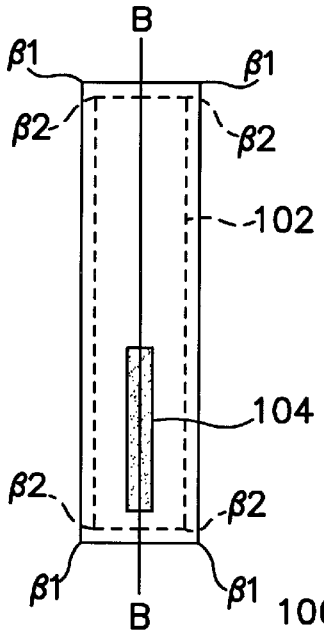
Figure 1C:
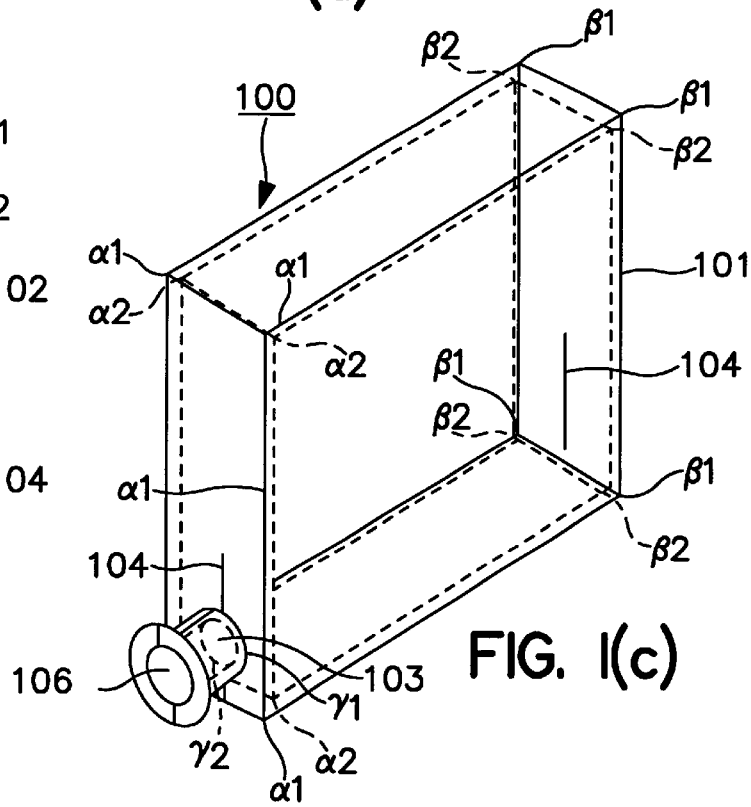
Figure 2A:
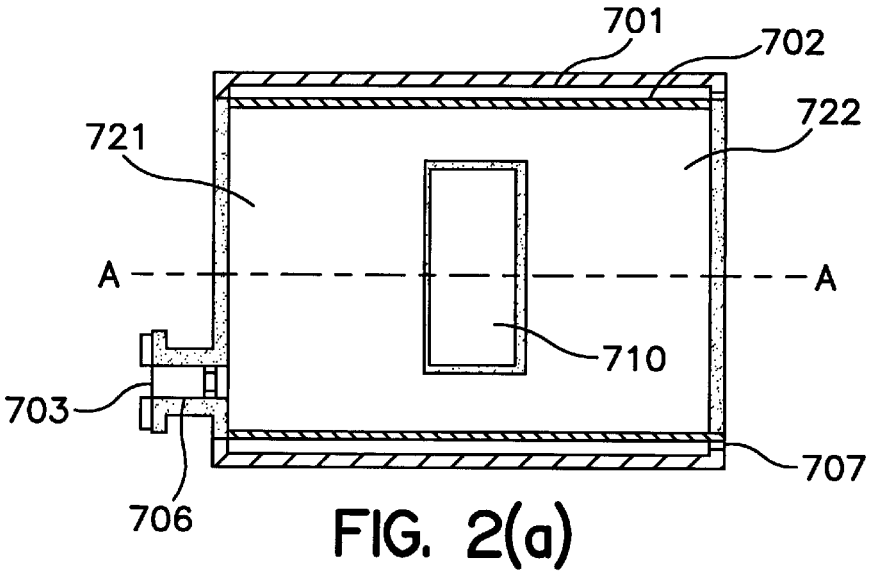
FIG. 2 Is an illustration of a liquid container according to first embodiment of the present invention, wherein (a), (b) are sectional views, (c) is a perspective view, and (d) shows a pinch-off portion.
Figure 2B:
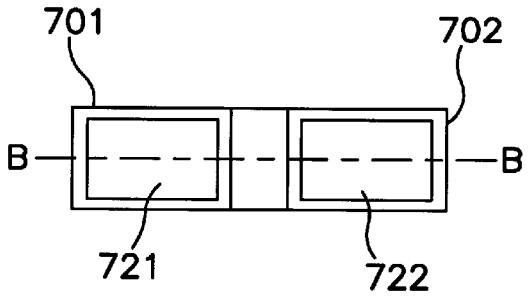
Figure 2C:
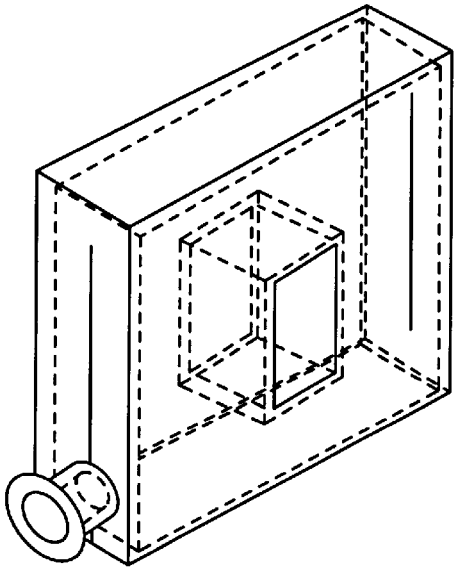
Figure 2D:
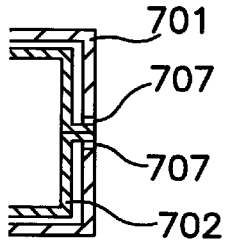

Referring to FIG. 1, the description will be made as to an example of a configuration of a container to which the present invention is applicable, before describing the embodiments of the present invention.

FIG. 1 ((a) and (b)) shows a structure of an ink container according to an embodiment of the present invention, wherein (a) is a sectional view, (b) is a side view, and (c) is a perspective view. The ink container of this embodiment is manufactured through a direct blow molding, with which an inner wall and an outer wall of the ink container are simultaneously molded through one step.

The ink container 100 shown in FIG. 1, (a) comprises an outer wall 101 and an inner wall 102. The ink is contained in an ink accommodating portion which is defined by inner wall 102, and the inner wall deforms with discharging of the ink therefrom. The outer wall 101 functions to protect the ink accommodating portion to prevent the leakage of the ink to the outside upon the unintentional deformation of the inner wall containing the ink. Designated by 103 is an ink supplying portion for supplying the ink out of the inside of the container, and functions as connecting portion with an ink introduction portion of an unshown ink jet head.

In FIG. 1, there seems to be a space between the outer wall 101 and the inner wall 102 of the ink container, since it is a schematic view, but they may be contacted to each other or spaced from each other with a small space, if they are separable. Therefore, in the initial state (initial state after start of use), the corners $\alpha$2, $\beta$2 of the inner wall 102 are at the inner side of the corners $\alpha$1, $\beta$1 of the outer wall 101, so that inner wall 102 of the ink container has a configuration similar to the outer wall 101 of the ink container, by which the inner wall 102 of the ink container extends along the outer wall 101 thereof functioning as the casing with a predetermined space therebetween. Thus, a dead space in a conventional container comprising a casing and a bladder-like container therein can be substantially removed, thus increasing the ink accommodation capacity per unit volume of the outer wall of the ink container (ink accommodation efficiency is increased).

Here, the corner means a crossing portion of at least 3 surfaces of polyhedron constituting the liquid container, and a portion corresponding to a crossing portion of extended surfaces thereof, and it is a bent portion from the beginning of molding. The reference characters designating the corners are such that a means corners formed by the surfaces having the ink supply port, and $\beta$ means the other corners; and suffix 1 is for the outer wall, and suffix 2 is for the inner wall. The crossing portions between the substantial flat surface and the curved surface of the cylindrical ink supplying portion is designated by $\gamma$; and the outer wall and inner wall are formed at the crossing portions, too, which are designated by $\gamma$1 and $\gamma$2.

In FIG. 1, the ink container 100 is constituted by eight flat surfaces, and a cylindrical ink supplying portion 103 having curved surface is added. The maximum area sides ot the inner and outer wall at the opposite sides of the ink supplying portion 103, among the 8 surfaces, are separated by six corner portions ($\alpha$1, $\beta$1, $\beta$1, $\beta$1, $\beta$1, $\alpha$1), ($\alpha$2, $\beta$2, $\beta$2, $\beta$2, $\beta$2, $\alpha$2), which will be described hereinafter.

The thickness distribution of the inner wall having the maximum area is such that thickness at the corner portion is thinner than that of the central portion, and the thickness gradually decreases toward the corner portion, so that it is convex toward the ink accommodating portion. The direction is the same as the direction of deformation of the surface, and it promotes the deformation, as will be described hereinafter.

The corner of the inner wall is provided by 3 surfaces, which will be described hereinafter, so that strength of the corner as a whole is relatively high as compared with the strength of the central portion of the surfaces. However, the surfaces at and adjacent each corner has a thickness smaller than the center portions of the surfaces providing the corner, thus permitting easy movement of the surfaces, as will be described hereinafter. It is desirable that portions constituting the inner wall corner have substantially the same thicknesses.

At the ink supplying portion 103, the crossing portions $\gamma$1, $\gamma$2 where cylindrical surface and a flat surface are crossed, is not easily deformed by the discharge of the ink due to normal printing operation of the ink jet recording means because the ink supplying portion is cylindrical. The configuration of the ink supplying portion is not limited to the cylindrical, though. It may be prism configuration, and even in such a case, the ink supplying portion of the sufficiently smaller than the ink accommodating portion, so that crossing portion is still not easily deformed by the ink discharging. Therefore, even when the ink is completely consumed, the inner wall and the outer wall are not deformed at the ink supplying portion and maintain the initial state.

Designated by 104 is a welded portion for forming a sealed space by the inner wall 102. The welded portion is provided by pinching a parison of an ink container by metal molds during blow molding which will be described hereinafter, and the inner wall 102 is welded and is closely contacted to the outer wall 101, and therefore, supports the inner wall 102 (functioning as a supporting portion). Referring to FIG. 1(*b*), the fused portion 104 in this embodiment looks linear, but the simple linear configuration is not mandatory; the configuration of the fused portion is optional as long as the ink container can be easily extracted from the die. Further, its length does not necessarily have to be limited to the length given in this embodiment; it is optional as long as the fused portion does not extend beyond the lateral walls.

A reference numeral 105 designates an air vent through which air is introduced between the inner shell 102 and the outer shell 101 when the volume of the inner shell 102 decreases in response to the consumption of the ink contained therein. It may be a simple opening or may be constituted of an air flow valve. In FIG. 1, this air vent is a simple opening (hole).

Designated by 106 is an ink discharge permission member provided with an ink leakage preventing function for preventing leakage of the ink from the ink supplying portion when a small scale vibration or external pressure is imparted to the container. It functions as a connecting portion relative to the ink jet head. It uses a unidirectional fibrous material of an ink absorbing material and has a meniscus retaining portion. It virtually seals the ink holding portion, and when the ink tapping member of the ink jet head is inserted into the ink supply port, it enables the ink within the ink holding portion to be fed out while maintaining the airtight condition.

Depending on the combination of the ink container 100 and the ink jet head, a rubber plug or valve is usable in place of a press-contact member at the ink discharge permission member 106.

The description will be made as to liquid containers according to the embodiments of the present invention.

(First embodiment)

FIG. 2 is an illustration of a liquid container according to first embodiment of the present invention, wherein (a), (b) are sectional views, (c) is a perspective view, and (d) shows a pinch-off portion. And, (a) is a sectional view taken along a line B–B' in (b), and (b) is a sectional view taken along an A–A' of (a). The structure is fundamentally the same as with FIG. 1, and it comprises an outer wall (casing) 701, an inner wall 702, a liquid supply portion 703, a pinch-off portion, a liquid discharge permission member 706.

In this embodiment, the central portion of a maximum area side of the liquid container, is provided with a through-hole 710, by which means the inner wall 702 and the outer wall 701 are substantially annular. The liquid supply portion 703 side of the outer periphery of the outer wall 701, the opposite side and the circumference of the through-hole 710, are pinch-off portions, so that liquid containing portion is separated into a first accommodating portion 721 closer to the liquid supply portion 703 and a second accommodating portion 722 at the opposite side with the through-hole 710 therebetween. In the liquid container of this embodiment, the corner portions of the inner wall correspond to the corner portions of the outer wall in the initial state, so that inner wall of the liquid container has a configuration similar to the outer wall 701 of the liquid container, by which the inner wall 702 of the liquid container extends along the outer wall 701 of the liquid container with a space of a predetermined range. Thus, the dead space existing when a bladder-like container is contained in a conventional casing, can be removed, so that liquid containing amount per unit volume of the outer wall of the liquid container can be increased (liquid containing efficiency can be increased).

In the pinch-off portion, as shown in FIG. 2, (d), the inner walls 702 are pressed and pinched by the outer walls 701, the inner wall 702 and the outer wall 701 are separable due to their materials, so that inner wall 702 and the outer wall 701 can be separated at the pinch-off portion, too, and therefore, a gap 707 is formed between the outer wall 701 and the inner wall 702. The gap 707 functions as an air vent path (air vent) to permit introduction of the air to between the inner wall 702 and the outer wall 701 when the volume of the inner wall 702 reduces as a result of consumption of the inside ink. The air vent may be provided in any different manner, without using the gap 707 at the pinch-off portion, and it may be provided by forming an opening in the outer wall, for example, as shown in FIG. 1.

In this embodiment, the pinch-off portion is provided along the entire width of the lateral side of the container, so that inner wall is stably supported, thus providing stabilized negative pressure with the discharged liquid.

Additionally, the pinch-off portions are provided widely at positions opposed to each other, by which the mechanical strength of the container per se is enhanced, and therefore, the container is reliable against external shock or the like. Depending on the thickness of the inner wall, the pinch-off portion may be separated from the outer wall 701, but even if it occurs, the direction of the deformation is limited because the pinch-off portion has a certain length. Accordingly, even when the pinch-off portion is separated from the outer wall, the deformation is not irregular, but proper balance is maintained.

The description will be made as to a supply operation of the liquid from the liquid container described in the forgoing.

When the liquid in the inner wall 702 is supplied to the outside through the liquid supply portion 703, the liquid in the first accommodating portion 721 close to the liquid supply portion 703 is first consumed.

When the liquid in the first accommodating portion 721 reduces, the inner wall of the first accommodating portion 721 tends to deform at such a position as is most easily deformed under the condition of the restriction against the deformation described hereinbefore. In this embodiment, the deformation starts at substantially the central portion of at least one of the surfaces of the inner wall corresponding to the maximum area sides of the outer walls of the first accommodating portion 721 among the substantially flat surfaces thereof.

Since the surface is substantially flat, it continuously deforms toward the surface opposite therefrom in accordance with the reduction amount of the liquid in the first accommodating portion 721. Therefore, the stabilization of the negative pressure time the liquid supply can be accomplished, and simultaneously, the ambience is introduced into between the inner wall 702 and the outer wall 701.

When the liquid is further supplied to the outside from the inside of the inner wall 702, the liquid in the second accommodating portion 722 is supplied into the first accommodating portion 721, so that liquid in the second accommodating portion 722 is supplied to the outside through the first accommodating portion and the liquid supply portion 703, by which the second accommodating portion 722 collapses similarly to the first accommodating portion 721.

With further supply of the liquid, the corner portions of the inner walls of the first accommodating portion 721 and the second accommodating portion 722 are removed or separated from the corresponding corner portions of the outer wall. Immediately after the disengagement of the corner portion, from the outer wall corner, the original configuration of the corner portion of the inner wall is maintained, so that corner portion has a function of being against collapse of the surface, but when the liquid is further supplied out, the configuration of the corner portion cannot be maintained with the result of deformation of the corner portion of the inner wall.

The thickness of the inner wall 702 having the maximum area is thicker in the center portion than the marginal portion by the manufacturing, but the strength is larger at the corner portion since three surfaces are crossed.

It is desirable that second accommodating portion 722 makes constant the degree of contraction of the first accommodating portion 721 relative to the liquid discharge amount.

The size of the through-hole 710 is not limited, but it is preferable to be 20% of the area of the maximum area side.

The provision of the through-hole in the liquid container enhances the mechanical strength, and permits stabilized supply of the liquid from the inside. In addition, the circumference of the through-hole is a pinch-off portion, and the ambience is introduced there between the inner wall and the outer wall to further stabilize the liquid supply.

The provision of the through-hole is effective to reinforce the maximum area side when the liquid containing portion contains the liquid to its maximum, and therefore, the outer surface of the inner wall and the inner surface of the outer wall are contacted to each other; and when the liquid is consumed, the provision of the through-hole is effective to maintain the position of the liquid containing portion against the external shock, since the inner wall is supported by the outer wall around the through-hole.

(Second embodiment)

In the first embodiment, the through-hole is provided at the center portion of the maximum area side of the liquid container. In the second embodiment, however, no through-hole is provided, but the inner wall portions opposed to each other at the through-hole position are stuck to each other, as if they are sandwiched by the outer walls to form a concave.

Figure 3A:
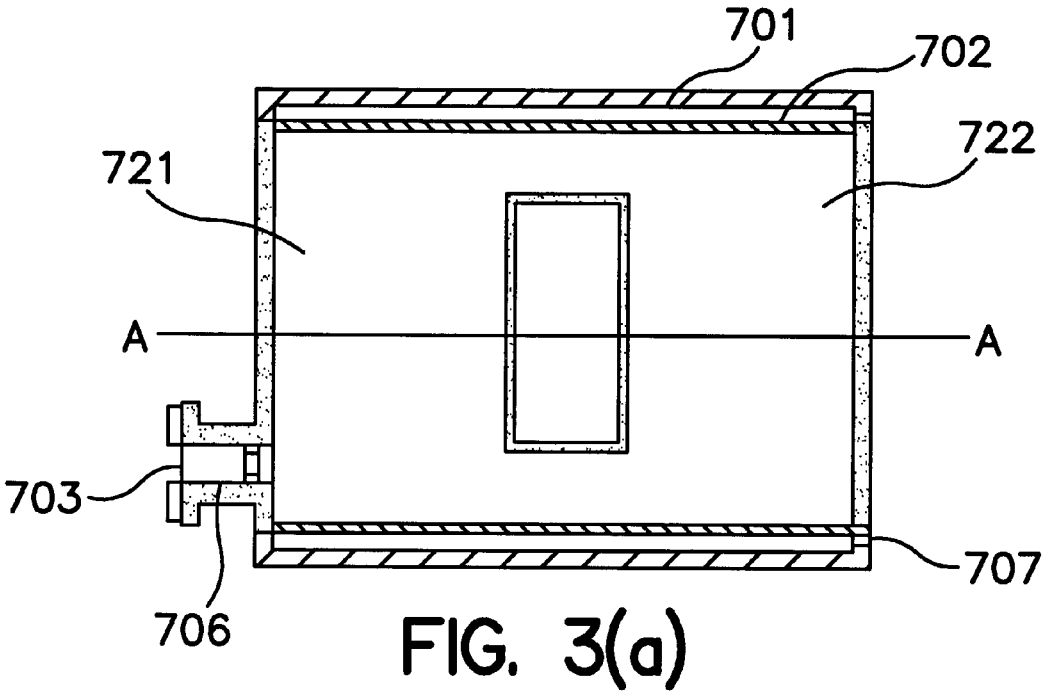
FIG. 3 is an illustration of an operation of a liquid container according to a second embodiment of the present invention, wherein (a) shows the maximum area side, and (b) is a sectional view taken along a line A–A'.
Figure 3B:
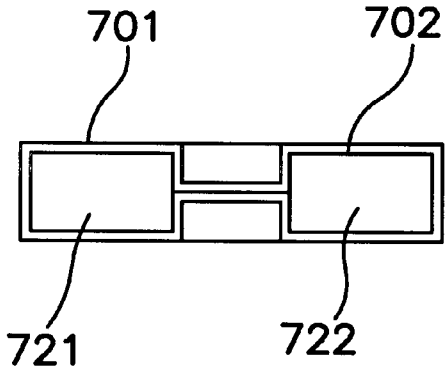

FIG. 3 is an illustration of an operation of a liquid container according to a second embodiment of the present invention, wherein (a) shows the maximum area side, and (b) is a sectional view taken along a line A–A'.

The behavior in this embodiment is substantially the same as in the foregoing if the stuck portion is located at the position where the pinch-off portion of the through-hole is disposed in the first embodiment. However, in this embodiment, as shown in FIG. 2, The inner wall 702 is fixed at the stuck portion at the center portion of the liquid container, and therefore, the inner wall 702 is more stabilized when an external shock is imparted.

In this embodiment, the stuck portion is at substantially the middle of the opposed surfaces having the maximum areas, but the present invention is not limited if it is parallel with the surface having the maximum area. An inner wall portion may be stuck to the other side.

(Third embodiment)

Figure 4:
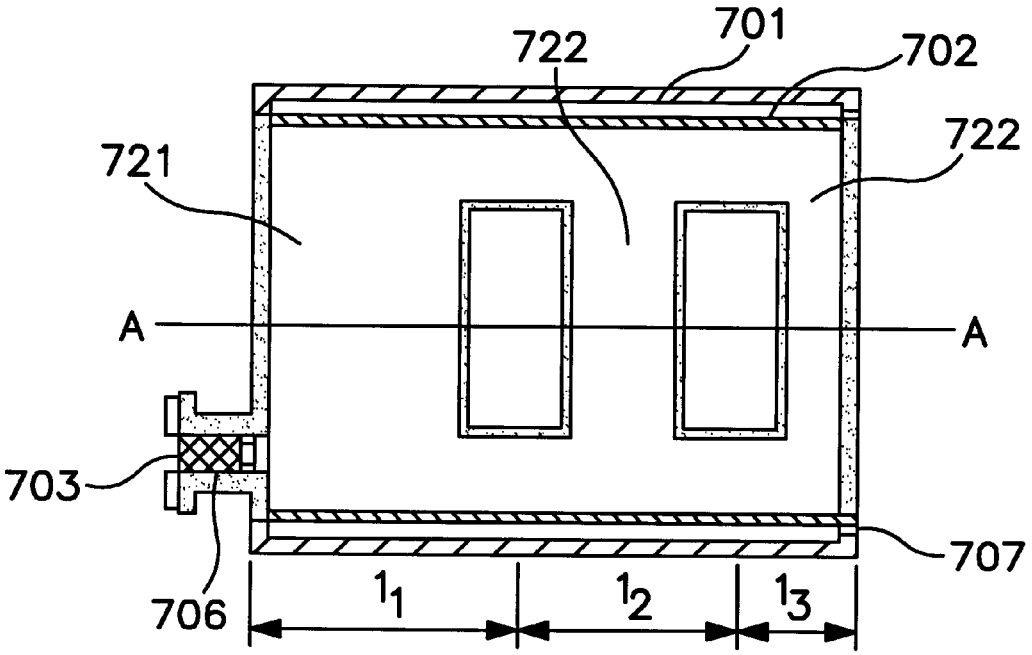
FIG. 4 is an illustration of a liquid container according to a third embodiment.
Figure 5A:
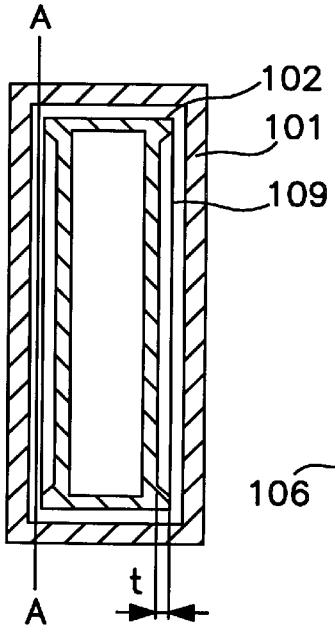
FIG. 5 is a sectional view showing a structure of a liquid container according to an embodiment of the present invention, wherein (a)–(b) and (c)–(d) are sectional views taken along a plane perpendicular to a maximum area side and A—A sectional views in a liquid container according to a fourth embodiment and a modified example thereof.
Figure 5B:
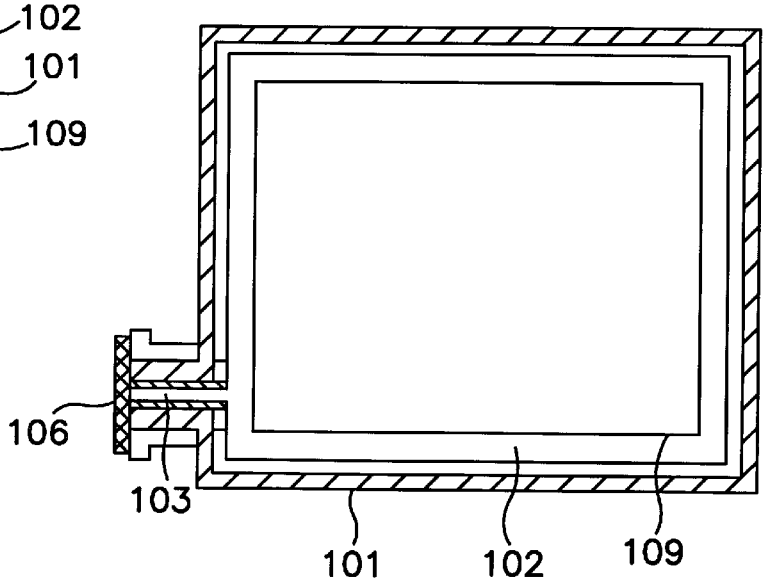
Figure 5C:
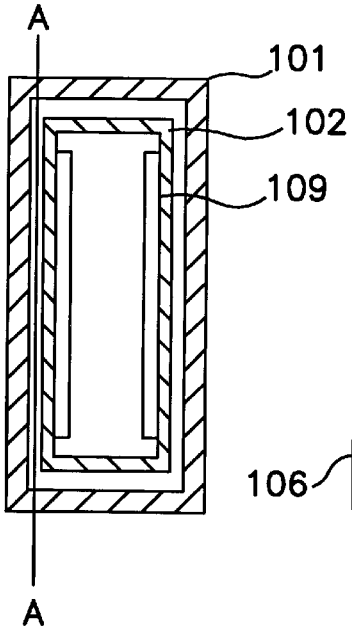
Figure 5D:
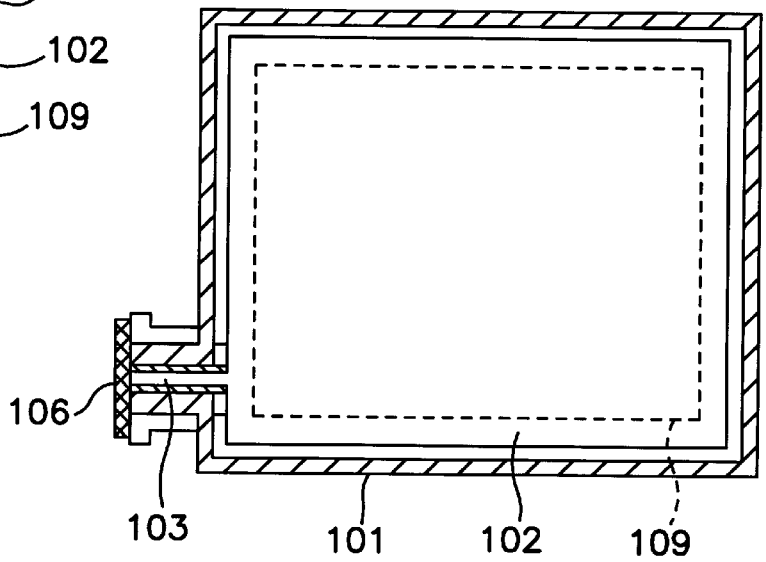
Figure 6A:
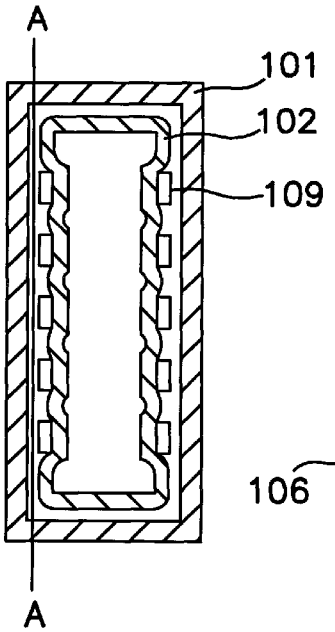
FIG. 6 is a sectional view showing a structure of a liquid container according to an embodiment of the present invention, wherein (a)–(b) and (c)–(d) are sectional views taken along a plane perpendicular to a maximum area side and A—A sectional views in a liquid container according to a fifth embodiment and a modified example thereof.
Figure 6B:
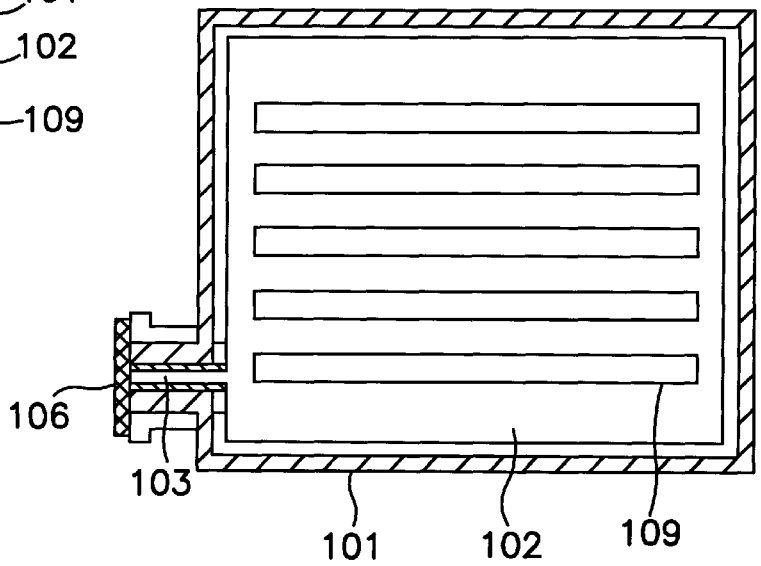
Figure 6C:
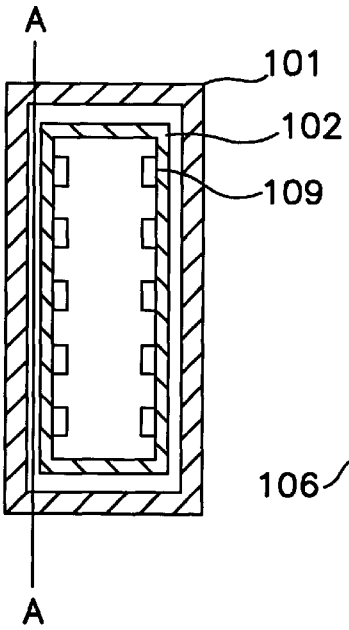
Figure 6D:
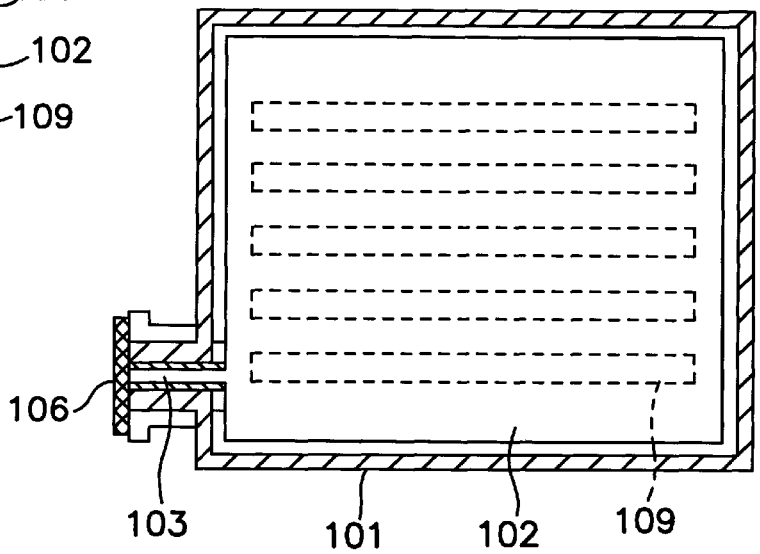
Figure 7A:
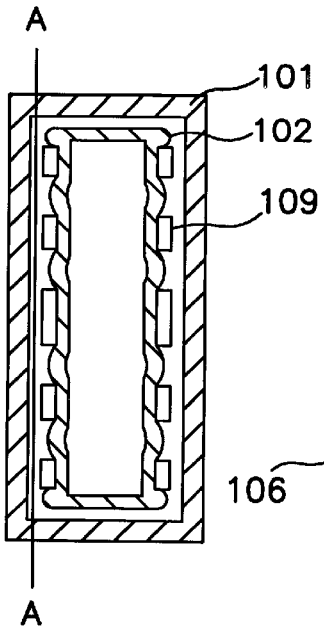
FIG. 7 is a sectional view showing a structure of a liquid container according to an embodiment of the present invention, wherein (a)–(b) and (c)–(d) are sectional views taken along a plane perpendicular to a maximum area side and A—A sectional views in a liquid container according to a sixth embodiment and a modified example thereof.
Figure 7B:
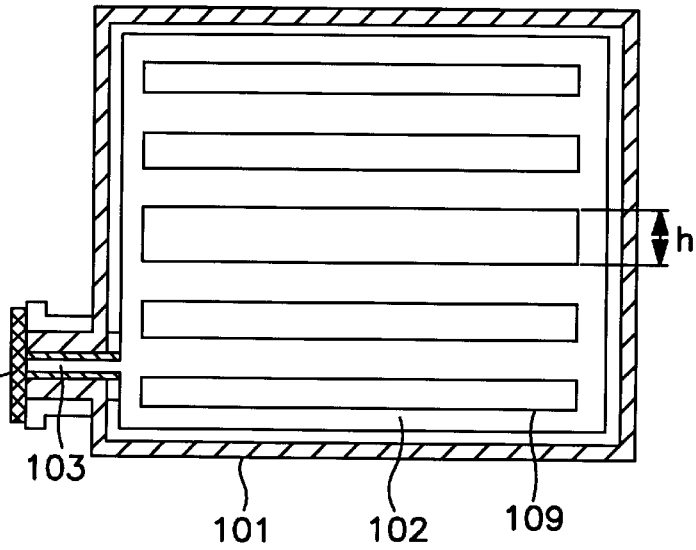
Figure 7C:
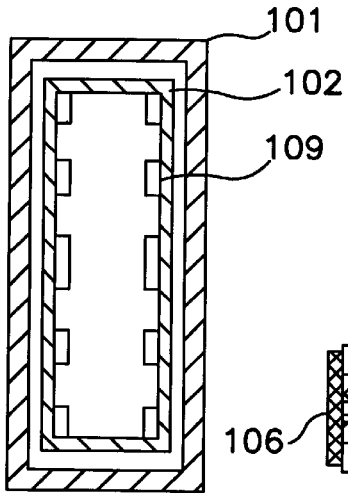
Figure 7D:
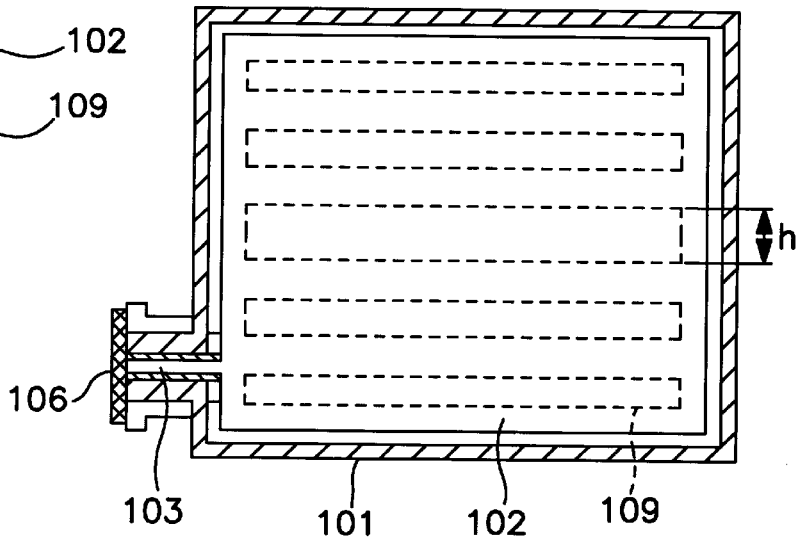
Figure 8A:
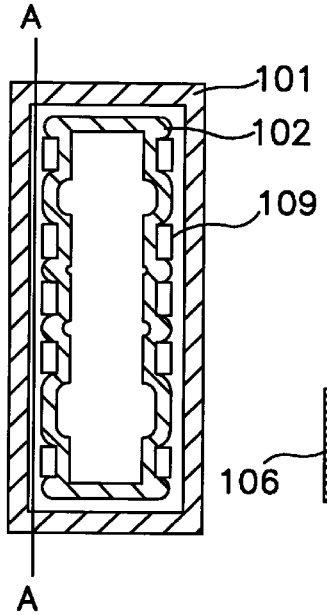
FIG. 8 is a sectional view showing a structure of a liquid container according to an embodiment of the present invention, wherein (a)–(b) and (c)–(d) are sectional views taken along a plane perpendicular to a maximum area side and A—A sectional views in a liquid container according to a seventh embodiment and a modified example thereof.
Figure 8B:
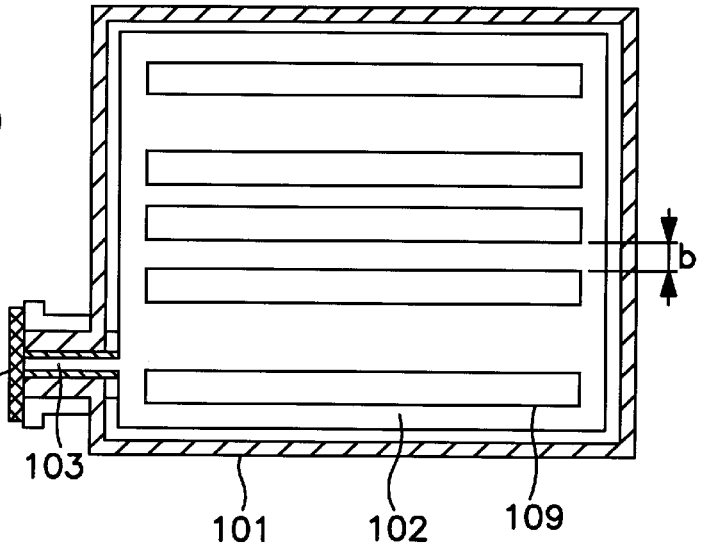
Figure 8C:
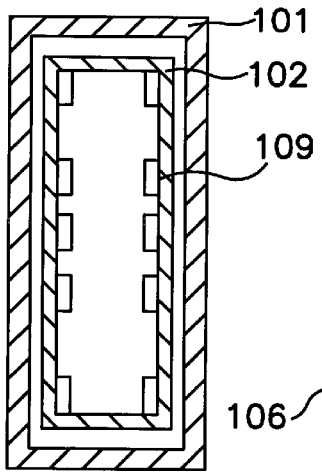
Figure 8D:
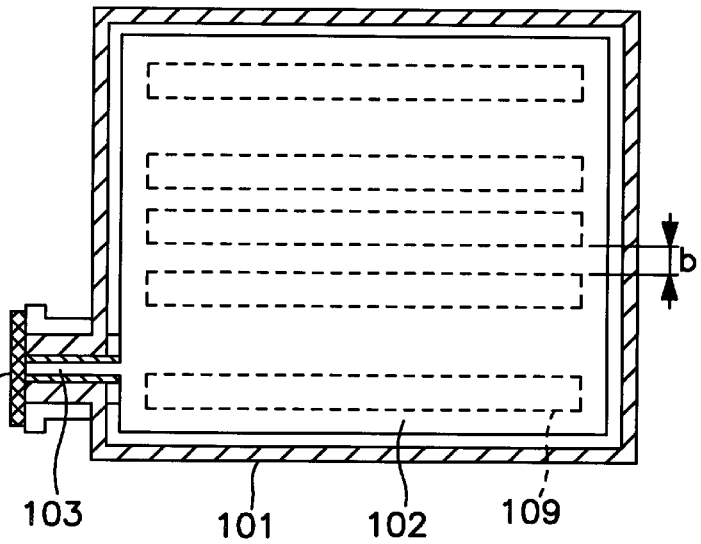
Figure 9A:
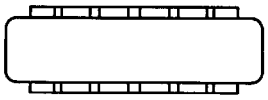
FIG. 9 is illustration of a liquid container according to an embodiment of the present invention, wherein (a)–(c) and (d)–(f) are a top plan view, a top plan view and a side view of a liquid container according to an eighth embodiment of the present invention, and, (g) is a sectional view illustrating a configuration of a projection formed in the liquid container.
Figure 9B:
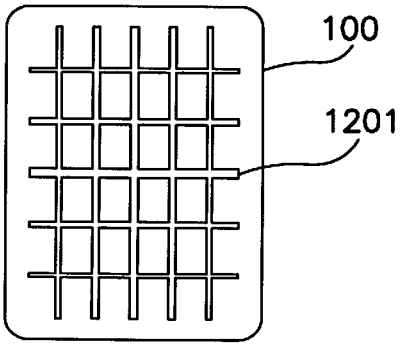
Figure 9C:
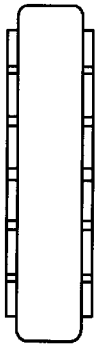
Figure 9D:
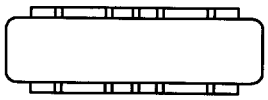
Figure 9E:
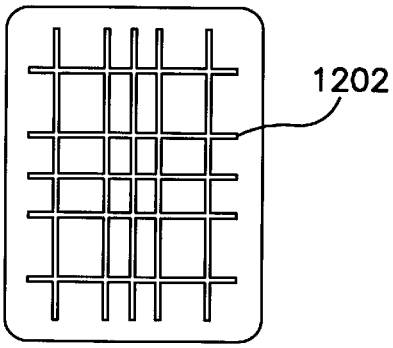
Figure 9F:
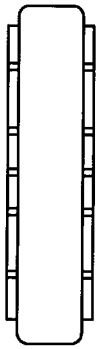
Figure 9G:
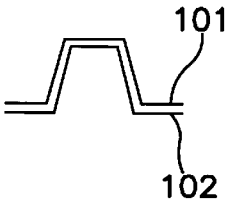
Figure 10A:
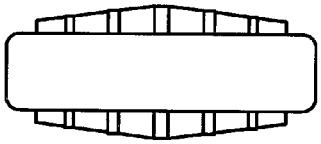
FIG. 10 illustrates a liquid container according to a ninth embodiment of the present invention, wherein (a)–(c) and (d)–(f) are top plan views, top plan views and side views of the container according to this embodiment and modification thereof.
Figure 10B:
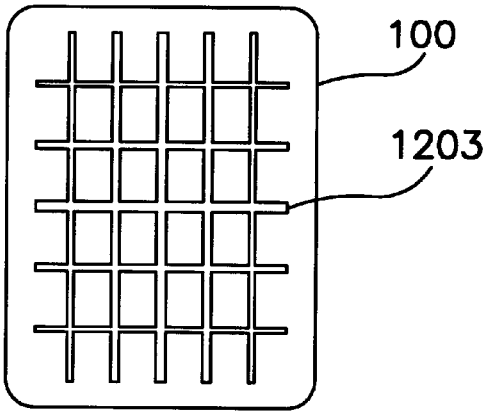
Figure 10C:
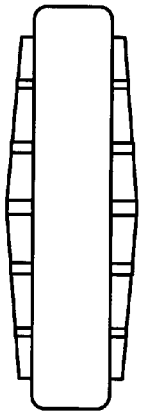
Figure 10D:
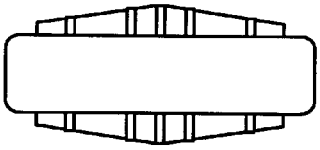
Figure 10E:
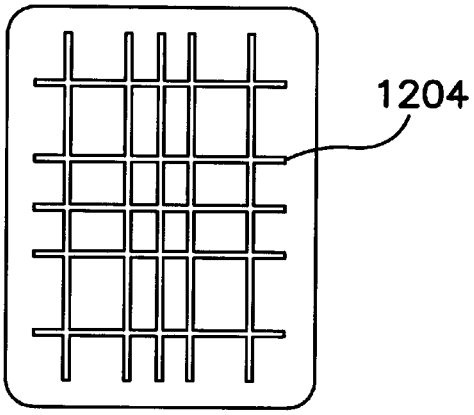
Figure 10F:
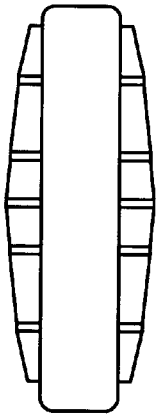
Figure 11A:
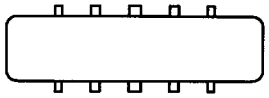
FIG. 11 ((a)–(c) and (d)–(f)) is a top plan view, a top plan view and a side view of a device according to tenth embodiment and a modified example, and, (g), (h) are sectional views of a projection formed on a liquid container.
Figure 11B:
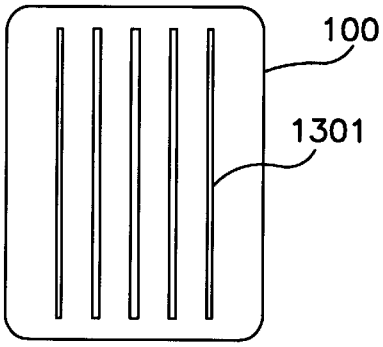
Figure 11C:
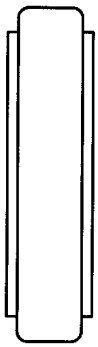
Figure 11D:
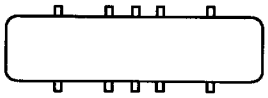
Figure 11E:
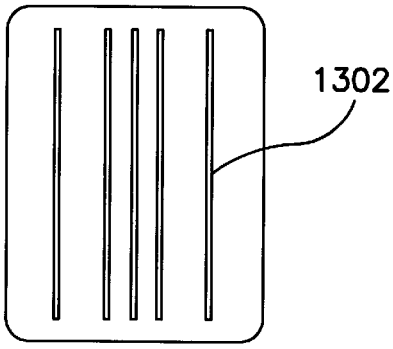
Figure 11F:
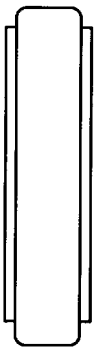
Figure 11G:
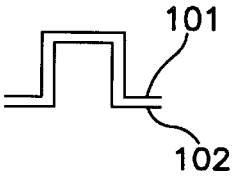
Figure 11H:
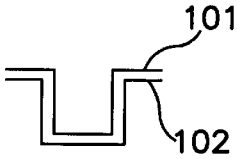
Figure 12A:
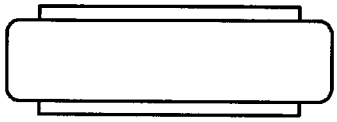
FIG. 12 is an illustration of a liquid container according to an eleventh embodiment of the present invention, wherein (a)–(c) and (d)–(f) are top plan views, top plan views and side views of the liquid container of this embodiment and the modification thereof.
Figure 12B:
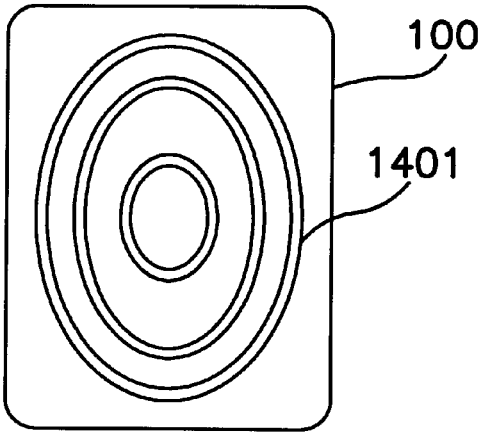
Figure 12C:
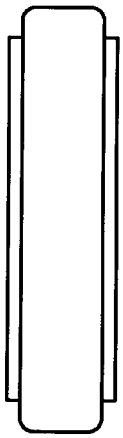
Figure 12D:
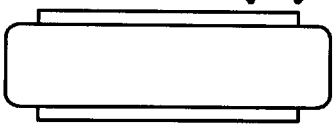
Figure 12E:
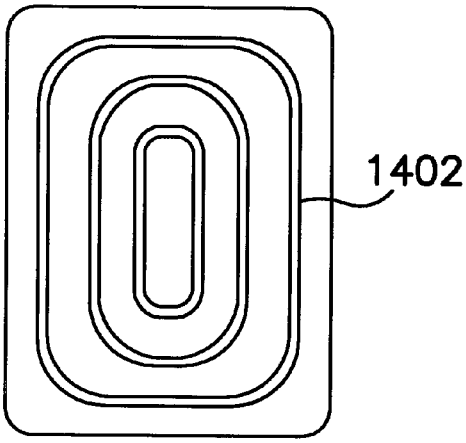
Figure 12F:
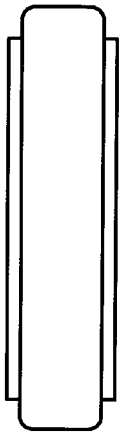

FIG. 4 is an illustration of a liquid container according to a third embodiment.

In this embodiment, as shown in FIG. 4, two through-holes 701 are provided. The positions where the through-holes 701 are provided, are determined such that first accommodating portion 721, a second accommodating portion 722 and a third accommodating portion 723 into which the liquid containing portion are separated by the through-holes 701 have the length 11, 12 and 13, wherein 11>12>13 is satisfied.

The liquid in the first accommodating portion 721 is first consumed, and then the liquid in the second accommodating portion 722 is consumed, and then the liquid in the third accommodating portion 723 is consumed.

In this embodiment, the number of the through-holes is two, but the number is not limited if the order of the consumptions of the liquid can be controlled. The effects of the first to third embodiments are as follows.

(1) Even when the size of the container is large, the strength against the external shock can be enhanced, and a negative pressure can be produced stably to permit stabilized supply of the liquid, by the division of the liquid containing portion.

(2) Even when the size of the container is large, the strength against the external shock can be enhanced, and a negative pressure can be produced stably to permit stabilized supply of the liquid, by the division of the liquid containing portion and by the permission of the air introduction around the through-hole into between the outer wall and the inner wall.

(Fourth embodiment)

FIG. 5 is a sectional view showing a structure of a liquid container according to an embodiment of the present invention, wherein (a)–(b) and (c)–(d) are sectional views taken along a plane perpendicular to a maximum area side and A—A sectional views in a liquid container according to a fourth embodiment and a modified example thereof. The fundamental structure of this embodiment is the same as that of FIG. 1 embodiment, the container comprises an outer wall (casing) 101, an inner wall 102, a liquid discharge portion 103, a pinch-off portion (unshown), an air introducing portion (unshown), and a liquid discharge permission member 106.

In this embodiment, a reinforcing member 109 is provided between the inner wall and the outer wall at the maximum area side of the inner wall 102 of the liquid container 100. The reinforcing member 109 is extended from the central portion of the maximum area side toward the neighborhood of the marginal portion, but it does not exists in the neighborhood of the marginal portion. The reinforcing member has a thickness which is large at the central portion, and decreases toward the marginal portion. The material of the container will be described hereinafter, but they are of materials which show good welding property (between the reinforcing member and the inner wall) so that reinforcing member is not separable from the inner wall. The combination of the inner wall and the reinforcing member are called inner shell. The thickness of the inner shell is smaller in the marginal portion than in the center portion. In this embodiment, the reinforcing member is provided at the maximum area side for the following reasons.

When the liquid is discharged from the liquid container as shown in FIG. 5, the inner wall tends to deform at a portion which is most easily deformed under the restricted condition. In this embodiment, the marginal portions of the inner shell corresponding to the maximum area side of the flat outer wall surfaces, do not have a corner portion or a reinforcing member, and the strength is low there so that these portions tend to deform inwardly. Against the inward deformation, the outer wall suppresses the displacement of the corner portion of the inner wall. The position of the corner portions $\alpha 2$, $\beta 2$ of the this liquid container hardly deforms, so that liquid containing portion receives the force toward the deformation due to the consumption of the ink and the force returning to the initial state, by which the negative pressure is stabilized.

When the liquid is further consumed, the portions of the maximum area sides which have the reinforcing member portions deform toward each other while maintaining the parallelism therebetween. The portion having the reinforcing member is substantially flat, so that it continuously and uniformly deforms toward the opposite surface in accordance with the reduction of the ink in the ink accommodating portion. Accordingly, there is no continuous large-scale deformation of the ink accommodating portion during ejection and non-ejection periods, so that negative pressure is stably formed and maintained.

Since the reinforcing member is to reinforce the maximum surface of the inner shell, it has a higher strength than the inner wall. Unlike the case where the thickness of the entirety of the inner wall is large, the strength is enhanced only at the zone except for the marginal portion, by which the local strength of the maximum area side can be adjusted.

Normally, a bladder-like container having a rectangular parallelopiped configuration as shown in FIG. 1, tends to deform first at the central portion of the maximum area side or side with the discharge of the liquid. However, in this embodiment, the thickness of the reinforcing member is larger at the central portion and is small at the marginal portion, so that resistance against the deformation is strong at the central portion, and decreases toward the marginal portion. At the initial stage of the use, the marginal portion is deformed assuredly, and the subsequent deformation responsive to the consumption of the liquid is promoted.

The forgoing disclosure has been made referring to FIG. 5, (a) and (b), but the reinforcing member may be provided inside the inner wall. FIG. 5, (c) and (d) show the example wherein it is provided inside the inner wall.

The thickness of the reinforcing member is different if the material of the reinforcing member and/or the desired strength is different, and it may be small if the strength of the material is large, but it is desirably not more than 10% of the thickness of the liquid container namely the movement distance of the maximum area side.

(Fifth embodiment)

FIG. 6 is a sectional view showing a structure of a liquid container according to an embodiment of the present invention, wherein (a)–(b) and (c)–(d) are sectional views taken along a plane perpendicular to a maximum area side and A—A sectional views in a liquid container according to a fifth embodiment and a modified example thereof.

In this embodiment, a plurality of the reinforcing members 109 of the fourth embodiment (FIG. 5) which are parallel with the longitudinal direction of the maximum area of the inner shell, are provided. FIG. 6, (a) and (b) shows an example having a reinforcing member between the inner wall and the outer wall, and FIG. 6, (c) and (d) shows a modified example having a reinforcing member at the liquid containing portion side of the inner wall.

This embodiment provides the same advantageous effects as the fourth embodiment, but the inner shell has an outer surface contacted to the inner surface of the casing without space therebetween due to the manufacturing method which will be described hereinafter, and therefore, when the reinforcing member is provided between the inner wall and the outer wall, the inner wall extends around the reinforcing member, as shown in FIG. 6, (a). For this reason, when it is necessary that reinforcing member has a larger thickness, it is desirable to provide the reinforcing member on the liquid containing portion side of the inner wall as in the modified example shown in FIG. 6, (c) and (d).

(Sixth embodiment)

FIG. 7 is a sectional view showing a structure of a liquid container according to an embodiment of the present invention, wherein (a)–(b) and (c)–(d) are sectional views taken along a plane perpendicular to a maximum area side and A—A sectional views in a liquid container according to a fifth embodiment and a modified example thereof.

In this embodiment, a plurality of the reinforcing members 109 are extended in the longitudinal direction of the maximum area side (fifth embodiment of FIG. 6), have a width h which Is large in the middle portion and is small in the marginal portion. FIG. 7, (a) and (b) shows an example having a reinforcing member between the inner wall and the outer wall, and FIG. 7, (c) and (d) shows a modified example having a reinforcing member at the liquid containing portion side of the inner wall. When larger thickness of the reinforcing member is desirable, the reinforcing member is desirably provided on the liquid containing portion side of the inner wall.

(Seventh embodiment)

Other embodiments will be described.

FIG. 8 is a sectional view showing a structure of a liquid container according to an embodiment of the present invention, wherein (a)–(b) and (c)–(d) are sectional views taken along a plane perpendicular to a maximum area side and A—A sectional views in a liquid container according to a fifth embodiment and a modified example thereof.

The following embodiments have the same fundamental structure as in the first embodiment shown in FIG. 1, and it comprises an outer wall (casing) 101, an inner wall 102, a liquid discharge portion 103, a pinch-off portion (unshown), an air vent (unshown), and a liquid discharge permission member 106.

In this embodiment, a plurality of the reinforcing members 109 parallel with the longitudinal direction of the maximum areas side of fifth embodiment (FIG. 6) is modified to have a clearance b which is small in the middle portion and large in the reinforcing member 109.

By the distribution of the space between the reinforcing members, the local strength can be more easily adjusted.

The effects of the fourth–seventh embodiment will are as follows. The provision of the reinforcing member permits the local adjustment of the strength against the collapse of the inner shell, so that negative pressure can be stabilized for a long term, and the ink can be stably supplied for a long term. The local adjustment thus permitted, allows the regulation of the collapse of the inner wall in accordance with the intended purpose.

(Eighth embodiment)

FIG. 9 is illustration of a liquid container according to an embodiment of the present invention, wherein (a)–(c) and (d)–(f) are a top plan view, a top plan view and a side view of a liquid container according to an eighth embodiment of the present invention, and, (g) is a sectional view illustrating a configuration of a projection formed in the liquid container. The fundamental structure of this embodiment is the same as that of FIG. 1 embodiment. However, in the present embodiment, a projection is provided. In FIG. 9, the supply port is not shown for the better illustration of this feature. In the embodiment, the use is made with a projection in place of the reinforcing member used in the fourth to seventh embodiment, by which the local strength against the collapse of the maximum area side, can be adjusted, thus providing the similar advantages as the reinforcing member. The member capable of adjusting a local strength against the deformation of the maximum area side is called deformation confinement member, including reinforcing member and the rib.

In this embodiment and the modified example thereof, the maximum area side of the liquid container 100 is provided with ribs 1201, 1202, and the opposing surface (unshown) of the surface shown in FIG. 9, (b) and FIG. 9, (e) is provided with the similar rib. The configuration of the projection (rib), as shown in the sectional view of FIG. 9, (g), is such that inner surface of the outer wall 101 and the outer surface of the inner wall 102 are equivalent or corresponding to each other, it is trapezoidal configuration projecting toward the outer wall 101 from the Inner wall 102. The configuration is not limited, and may be rectangular (rectangular), or may project from the outer wall 101 toward the inner wall 102. The ribs 1201, 1202 are extended to the neighborhood of the marginal portion of the maximum side, and it is curved to form a small curved surface configuration at the marginal portion.

When the rib is formed projected outwardly of the liquid container 100 as shown in FIG. 9, (g), the central portion is less easily deformed toward the inside than the case in which it is projected inwardly in accordance with the consumption of the ink. In the portion where the projection is provided, the inner wall 102 is not easily separated from the outer wall 101, and therefore, the strength against the collapse increases.

The ribs 1201 in the embodiment and the ribs 1202 in the modified example are in the form of a lattice. In this embodiment, the ribs 1201 are uniformly distributed in the longitudinal direction (vertical on the Figure) and in the horizontal direction, and projections having different widths are combined.

If the elongated projections are uniformly arranged In the longitudinal and horizontal directions, the result is that strength of the maximum area side is entirely enhanced. Therefore, the local strength adjustment against the collapse of the maximum area side cannot be controlled. In the eighth embodiment, the width is larger in the central portion, and in the modified example, the intervals are smaller in the central portion, and are larger at the marginal portion. Thus, the strength or the resistance against the deformation is larger in the central portion and is smaller in the marginal portion.

The larger width of the rib does not directly means the larger strength. But, when the liquid container 100 is manufactured through the blow molding, the resin material easily goes around, and the inner wall configuration and the outer wall configuration correspond to each other as shown in FIG. 9, (g), and therefore, the strength against the deformation increases as a result.

In this embodiment, the thickness of the inner wall 102 was 0.5 mm; the thickness of the outer wall 101 was 1.0 mm; and the height of the rib was approx. 1.2 mm. The practical width of the rib in this case was 1.5 mm–2.0 mm. When the width is smaller, the resin material goes less easily around, and therefore, the molding becomes difficult. From this standpoint, it is desirable to form an elongated projection having a larger width than that. The ration thereof to the thickness of the liquid container is desirably approx. 5–30%.

(Ninth embodiment)

FIG. 10 illustrates a liquid container according to a ninth embodiment of the present invention, wherein (a)–(c) and (d)–(f) are top plan views, top plan views and side views of the container according to this embodiment and modification thereof.

The fundamental structure of this embodiment is the same as that of FIG. 1. In FIG. 10, the supply port is omitted for the better illustration of a projection.

This embodiment is a modification of the eighth embodiment shown in FIG. 9 as a deformation confinement member, wherein thicknesses of the ribs 1201, 1202 are modified to be larger in the central portion of the maximum area side, and are decreased gradually toward the marginal portion, and these modified ribs are shown as ribs 1203, 1204. With this configuration, the resistance against the collapse can be enhanced in the central portion of the maximum area side.

In the ninth embodiment, the thickness linearly changes, and in the modified example it gradually non-linearly changes. Either is usable.

(Tenth embodiment)

FIG. 11 ((a)–(c) and (d)–(f)) is a top plan view, a top plan view and a side view of a device according to tenth embodiment and a modified example, and, (g), (h) are sectional views of a projection formed on a liquid container.

The fundamental structure of this embodiment is the same as that of FIG. 1. In FIG. 11, the supply port is omitted for the better illustration of a projection.

In this embodiment and its modified example, ribs 1301, 1302 are formed on the maximum area side of the liquid container 100. Each rib 1301, 1302 is in the form of an elongated projection extending in the vertical direction (Figure) of the maximum area side. Similarly to the foregoing eighth and ninth embodiments, the similar ribs are formed on the side (unshown) opposite from the side shown in the Figure.

The ribs 1301 in this embodiment are uniformly distributed from the center of the maximum area side, and the widths reduce away from the center so that strength or resistance against the collapse is high in the center portion of the maximum area side. The ribs 1302 formed in the modified example of this embodiment have the same widths, but they are arranged at higher density in the center portion of the maximum area side then the marginal portion so that resistance against the collapse is higher in the central portion of the maximum area side.

In this embodiment, the ribs are extended only in the vertical direction to provide uniform vertical collapse, thus regulating the deformation of the liquid container 100. Although not shown in the drawing, the widths and/or the arrangement of the ribs may be determined such that resistance against the collapse is high adjacent to the supply port, by which the deformation is forced to start at a position away from the supply port, so that ink accommodated therein can be efficiently consumed.

The configurations of the elongated projections may be as shown in FIG. 9, (g) (trapezoidal configuration), and may be the ones shown in FIG. 11, (g), FIG. 11, (h) (rectangular). It may project from the inner wall 102 toward the outer wall 101 or may be a combination with projections from the outer wall 101 toward the inner wall 102. By employing the projection projecting from the outer wall 101 toward the inner wall 102, the deformation can be started at an earlier stage. Such projections may be provided at positions distant from the supply port to permit the deformation to increase the ink consumption efficiency.

(Eleventh embodiment)

FIG. 12 is an illustration of a liquid container according to an eleventh embodiment of the present invention, wherein (a)–(c) and (d)–(f) are top plan views, top plan views and side views of the liquid container of this embodiment and the modification thereof.

The fundamental structure of this embodiment is the same as that of FIG. 1. In FIG. 11, the supply port is omitted for the better illustration of a projection.

Figure 13A:
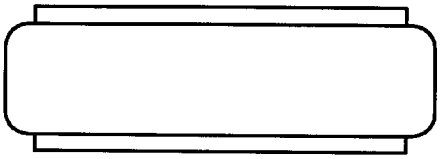
FIG. 13 ((a)–(c)) is a top plan view, a top plan view and a side view of a device according to an eleventh embodiment of present invention and a modified example thereof.
Figure 13B:
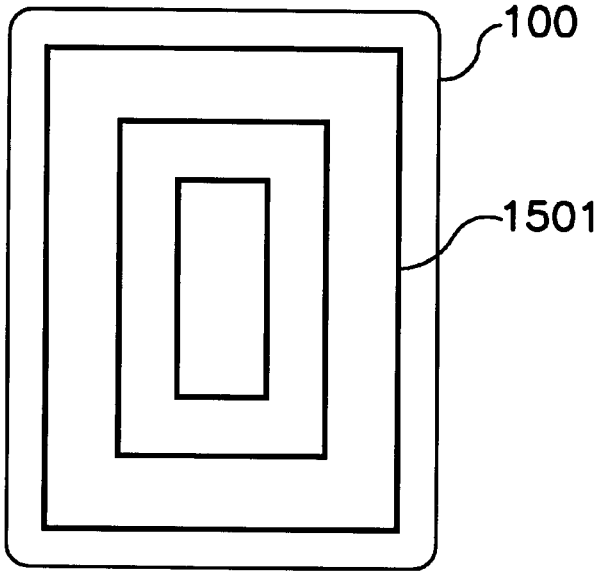
Figure 13C:
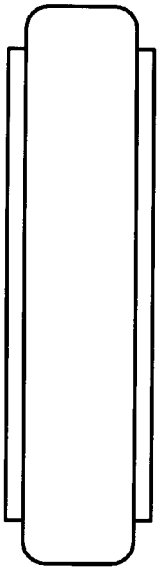
Figure 15A:
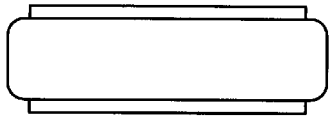
FIG. 15 ((a)–(c) and (d)–(f)) is a top plan view, top plan view and a side view of a device according to a thirteenth embodiment of the present invention a modification thereof.
Figure 15B:
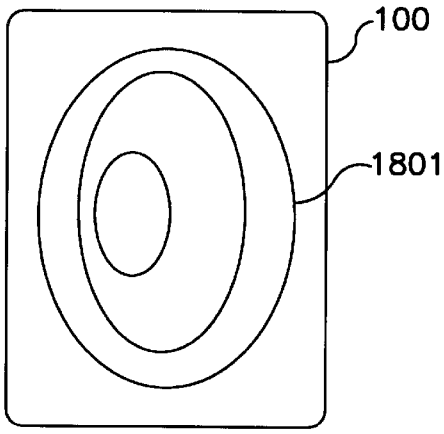
Figure 15C:
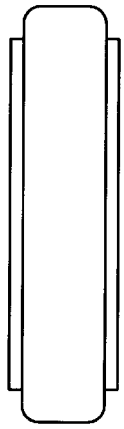
Figure 15D:
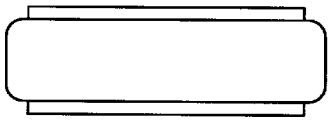
Figure 15E:
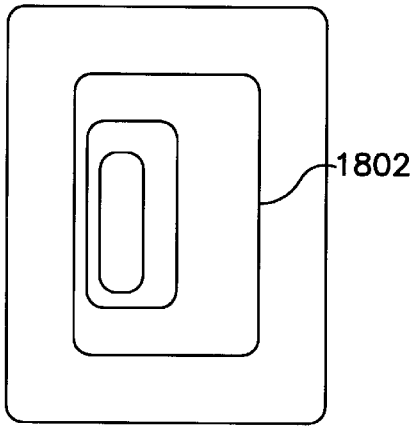
Figure 15F:
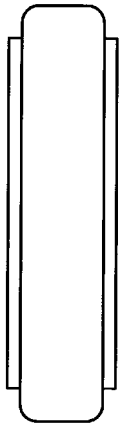
Figure 16A:
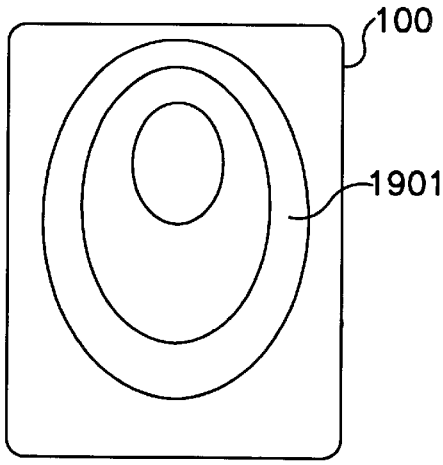
FIG. 16 ((a)–(c) and (d)–(f)) is a top plan view, a top plan view and a rear surface Figure of a fourteenth embodiment of the present invention and a modification thereof.
Figure 16B:
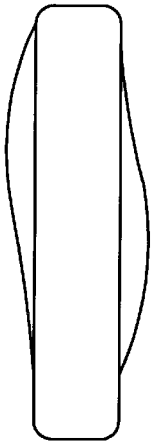
Figure 16C:
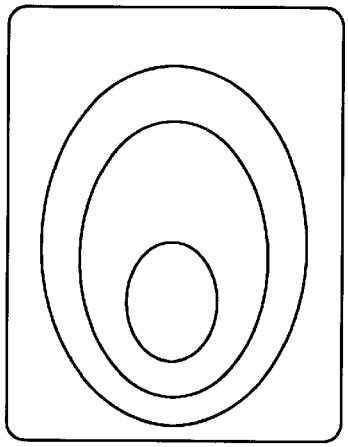
Figure 16D:
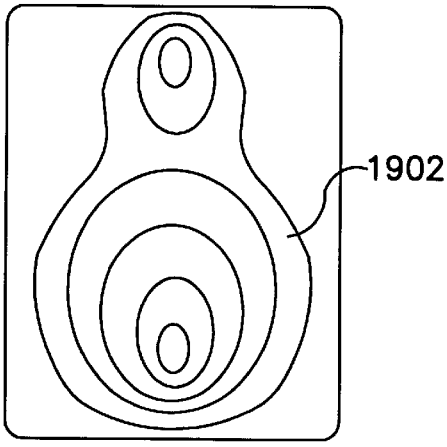
Figure 16F:
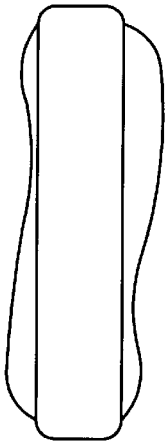
Figure 16E:
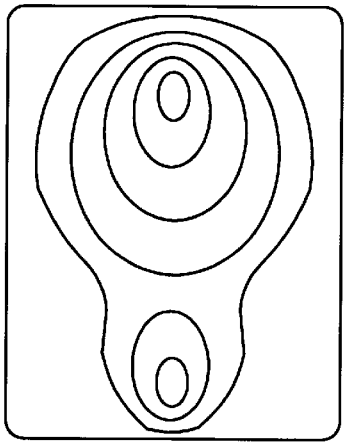

In the eleventh embodiment shown in 12, (a)–(c), concentric elliptical ribs 1401 having different diameters, are formed on the maximum area side of the liquid container 100. In the modified example shown in FIG. 12, (d)–(f), ribs 1402 are substantially concentric rectangular which are rounded at the corner portions. In the modified example shown in FIG. 13, (a)–(c), ribs 1501 are substantially concentric rectangular having different sizes. Similarly to the foregoing embodiment, the similar ribs are formed on the opposite sides (unshown).

Ribs 1401, 1402, 1501 constituting the projections are arranged concentrically about the center of the maximum area side, thus increasing the strength against the deformation at the center portion thereof. Therefore, the deformation substantially occurs from the marginal portion toward the central. portion. The intervals of the ribs may become smaller toward the center portion of the maximum area side as in the foregoing embodiment.

(Twelfth embodiment)

FIG. 14 ((a)–(c) and (d)–(f)) is a top plan view, a top plan view and a side view of a device according to twelfth embodiment and a modified example.

The fundamental structure of this embodiment is the same as that of FIG. 1. In FIG. 14, the supply port is omitted for the better illustration of a projection.

In this embodiment and the modified example thereof, the maximum area side of the liquid container 100 is provided with ribs 1601, 1602. Each rib 1601, 1602 is in the form of an elongated projection extending in the vertical direction (Figure) of the maximum area side. Similarly to the foregoing embodiments, the similar ribs are formed on the side (unshown) opposite from the side shown in the Figure.

The ribs 1601 of this embodiment is in the form of columnar projections having different sizes, wherein the sizes of the projections gradually decreases away from the center of the maximum area side. In the modified examples of this embodiment, shown in FIG. 14, (d)–(f), the ribs 1602 are column-like projections, wherein the sizes of the projections gradually decreases away from the center of the maximum area side.

In this embodiment and modified example, by the structure described above, the strength against the collapse is higher in the center portion of the maximum area side. By arranging a plurality of small projections in the marginal portion, the strength, against the collapse, along the line connecting the outer periphery portion is uniform, so that collapsing way can be controlled.

In this embodiment, the deformation occurs along the broken line shown in FIG. 14, (b), so that deformation occurs similarly to eleventh embodiment. In the modified examples, the deformation occurs along the broken line in FIG. 14, (e). The configuration of the projection, may be trapezoidal as shown in FIG. 14, (g), but may be semi-spherical as shown in FIG. 14, (i). The configuration of the column-like projection in the modified examples shown in FIG. 14, (d)–(f), is as shown in FIG. 14, (h). By selecting the aspect ratio (x:y), the strength against the collapse can be adjusted.

(Thirteenth embodiment)

FIG. 15 ((a)–(c) and (d)–(f)) is a top plan view, a top plan view and a side view of a device according to thirteenth embodiment and a modified example, and, (g), (h) are sectional views of a projection formed on a liquid container.

The fundamental structure of this embodiment is the same as that of FIG. 1. In FIG. 15, the supply port is omitted for the better illustration of a projection.

In the embodiment and the modified examples, the elliptical projections having different diameters or the rounded rectangular projections having different sizes (similar to eleventh embodiment), are not concentric, but are offset (ribs 1801, 1802). In the embodiment and the modified examples, the similar ribs are formed on the opposite side (unshown), but the ribs on the opposite side are offset toward right as seen from the outside, so that they are overlapped with the ribs 1801, 1802, as seen redioscopically.

In this embodiment and modified example, the plurality of projections are deviated toward the left in the drawing so that strength in the left side is higher than in the right side. In such a case, the deformation starts in the right side and progresses toward the left. Although not shown in the drawing, the projections may be arranged such that strength against the collapse is higher adjacent the supply port, by which the deformation starts at positions remote from the supply port, thus accomplishing the efficient use of the ink.

(Fourteenth embodiment)

FIG. 16 ((a)–(c) and (d)–(f)) is a top plan view, a top plan view and a rear surface Figure of a fourteenth embodiment of the present invention and a modification thereof.

The fundamental structure of this embodiment is the same as that of FIG. 1, In FIG. 16, the supply port is omitted for the better illustration of a projection.

In this embodiment and the modified example thereof, there are provided projections 1901, 1902 having different configurations on the opposite maximum area sides. The projection 1901 formed in the fourteenth embodiment has a single apex, and in the modified example, the projection 1902 has two apexes. The curves in FIG. 16, (a), (c), (d) and (e) does not show the actual configuration, but is contour lines of the maximum area sides.

In the foregoing embodiments, the projections (deformation confinement member) are disposed at the same positions when the maximum area sides are seen redioscopically, but in this embodiment, the apexes of the projection 1901 and the projection 1902 are deviated from each other and from the center of the maximum area side when the maximum area side is seen radioscopically, and the lowest height positions of the projections are different. By this, the ink flow path is assuredly formed even when the maximum area sides are contacted to each other.

The advantages of the deformation confinement member in the eighth–fourteenth embodiments are as follows.

Similarly to fourth embodiment to seventh embodiment, the strength again the collapse of the inner wall can be locally adjusted, so that negative pressure can be stabilized for a long term. The local adjustment thus permitted, allows the regulation of the collapse of the inner wall in accordance with the intended purpose. The strength of the outer wall is enhanced by the formation of the rib, and therefore, the thickness of the outer wall can be reduced, thus permitting reduction of the manufacturing cost. When the container is carried on a carriage of the ink jet recording apparatus, the resultant reduction of the weight makes design of the carriage easier, and permits low mechanical strength material can be used, thus further permitting easy design.

In the foregoing Embodiment 1–14, the shock resistance is assured without increasing the dead space in the container, and the ink supply with negative pressure can be accomplished, even when the size of the container is large. The size of the container to which the embodiments are usable is about 10–1000 $cm^3$ although it is dependent upon the thickness and the strength or the like of the inner wall.

When the size is large, the static head difference can be additionally used to stabilize the supply of the liquid. In such a case, the disposition space required can be made smaller than when only the static head difference is used. When the static head difference is also used, the upper limit of the size. of the container to which the present invention is usable, is larger than the above-described upper limit 1000 $cm^3$.

(Other embodiments)

Other embodiments usable with the present invention will be described. The following embodiments are usable to all of the foregoing embodiments, unless particularly stated to the contrary. In the figures referred to in the following description, the pinch-off portion or deformation confinement member (reinforcing member or rib) provided on the maximum area side is omitted for simplicity.

<Manufacturing method>

A manufacturing method for the container according to the foregoing embodiments will be described.

The ink container of the present invention has a double wall structure of molding resin material, and the outer wall (casing) is thick to provide enough strength, and on the other hand, the inner wall is of soft material and is thin to permit to follow the variation of the volume of the ink. The inner wall is provided with non-separable reinforcing members. The material of the inner wall is desirably the one having an anti-ink property, and that of the outer wall desirably has a shock resistance, and the material of the reinforcing member used in fourth to seventh embodiments desirably has a strength.

In the fourth to seventh embodiments, when the reinforcing member is provided between the outer wall and the inner wall, it desirably does not have the welding property relative to the outer wall, and when the reinforcing member is provided on the inside of the inner wall, the material thereof desirably exhibits good contact property relative to the liquid.

In this embodiment, a method using blow molding is employed so that structural walls of the ink container can be formed without drawing the resin materials. By doing so, structural walls of the ink container can be formed without drawing the resin materials. Therefore, the inner wall of the ink container, which constitutes the ink holding portion, is enabled to substantially omnidirectionally withstand the load. As a result, no matter which direction the ink remaining in the inner wall shifts after the ink contained in the inner wall is consumed by a certain amount, the inner wall can reliably retain the ink, thus further improving the overall durability of the ink container.

As for the choice of blow molding, injection blow molding, direct blow molding, double wall blow molding, and the like are available.

The description will be made as to a manufacturing step for a container having a reinforcing member of fourth embodiment using a direct blow molding.

Figure 17A:
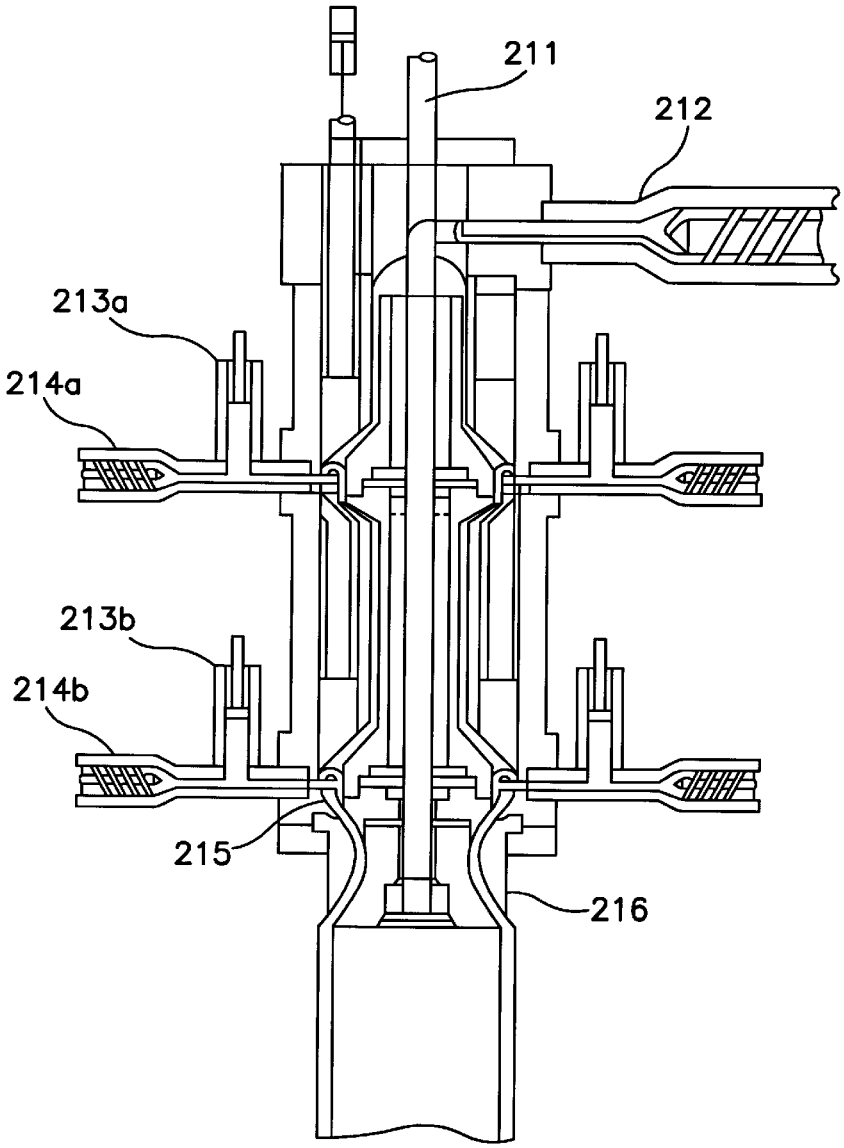
FIG. 17 ((a)–(d)) shows a manufacturing step of an ink container of the present invention.
Figures 17B, 17C, 17D:
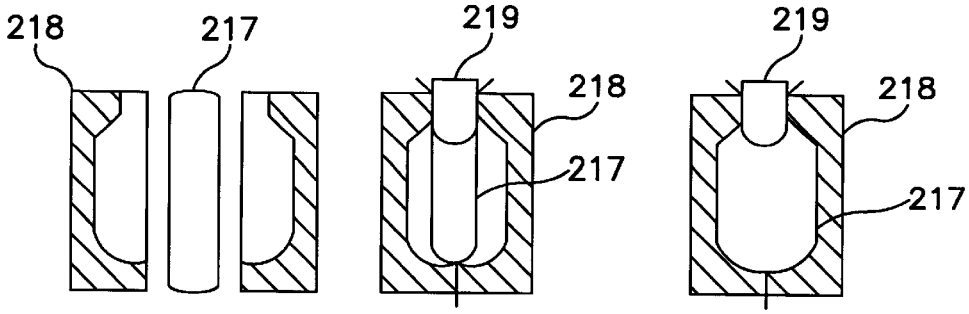
Figure 18A:
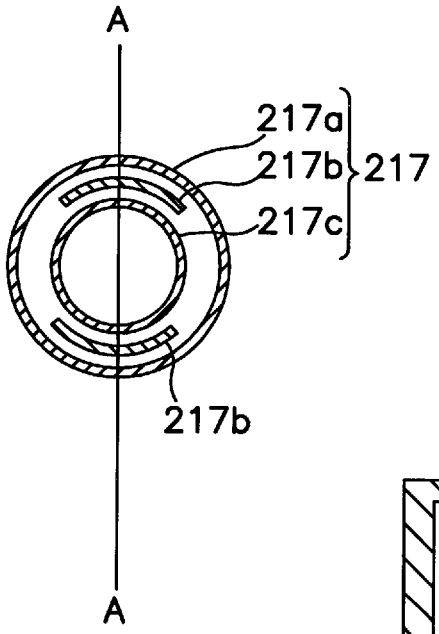
FIG. 18 is an illustration of a parison including intermittent reinforcing members, wherein (a) is a sectional view taken along a plane perpendicular to a supply direction of the parison, and (b) is a sectional view taken along a line A—A in (a), showing a nipping portion of the parison and a metal mold.
Figure 18B:
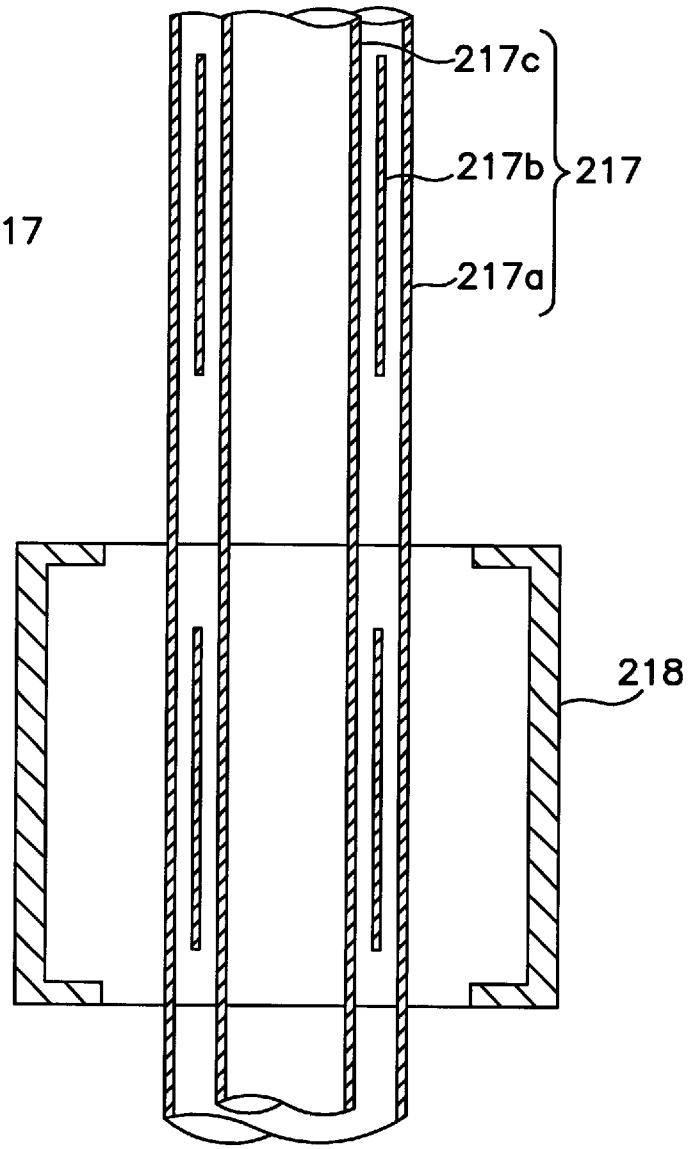

FIG. 17 ((a)–(d)) shows a manufacturing step of an ink container of the present invention. FIG. 18 is an illustration of a parison including intermittent reinforcing members, wherein (a) is a sectional view taken along a plane perpendicular to a supply direction of the parison, and (b) is a sectional view taken along a line A—A in (a), showing a nipping portion of the parison and a metal mold.

In FIG. 17, designated by 211 is a main accumulator for supplying inner wall resin material; 212 is a main extruder for extruding the inner wall resin material; 213*a* is a sub-accumulator for supplying the assistance member resin material; 214*a* is a sub-extruder for extruding the assistance member resin material; 213*b* is a sub-accumulator for supplying the outer wall resin material; and 214*b* is a sub-extruder for extruding the outer wall resin material.

A multi-layer nozzle is used as an injection nozzle, and resin material (outside resin material) 217*a* for forming a casing and resin material for forming an inner shell (inside resin material) 217*b* and 217*c*, are simultaneously ejected to manufacture a substantially cylindrical parison 217 comprising integral first and second parisons. At this time, the layer 217*a* for forming the casing and the layer 217*c* for forming the inner wall are supplied continuously in both of the direction of the supply and the direction perpendicular thereto, but the layer 217*b* for forming the reinforcing member are supplied intermittently in both of the direction of the supply and the direction perpendicular thereto. FIG. 18 shows a parison for manufacturing the liquid container of the fourth embodiment. In this case, since a reinforcing member is provided on the inside of the inner wall, the separation layer 217*b* is arranged inside the separation layer 217*c* for the inner wall. The sub-accumulator 213*a* of the manufacturing apparatus and the sub-extruder 214*a* thereof are used for the inner wall, and the sub-accumulator 211 and the sub-extruder 212 are used for the assistance member. The extruding manner of the extruder is such that layer 217*c* for the inner wall is continuous in both of the direction of supply and the direction perpendicular thereto, and the layer 217*b* for the reinforcing member is intermittent in both of the supply direction and perpendicular thereto.

When a plurality of reinforcing members are provided on the maximum area side as in fifth to seventh embodiments, the reinforcing member is separated in the section shown in FIG. 18, (a). In such a case, the extruding manner of the extruder is changed properly.

Thus, the resin material for the reinforcing member is supplied in parallel with the direction of the supply of the parison, and therefore, when a plurality of reinforcing members are to be provided on the maximum area side, the longitudinal direction of the maximum area side is made the same as the parison supply direction and as the direction of the reinforcing member from the standpoint of the easy division of the mold. In the foregoing fifth—the seventh embodiments, the plurality of the reinforcing members are extended in parallel with the longitudinal direction in view of the above, but it is possible to provide the rib perpendicular to the longitudinal direction of the parison supply direction if the parison supply direction and the longitudinal direction of the maximum area side are made orthogonal to each other.

As for the supply of the resin material, the inside resin material and the outside resin material may be contacted, and they may be out of contact, or they may be partly contacted. When they are contacted, the surfaces where they are contacted are of the materials which are non-contactable to each other, or a chemical compound is added to one of the materials to make them separable. When similar kinds of materials have to be used because of the hydrophilicity to the ink or the configuration, the inside material or the outside material is given a multi-layer structure so that contact surfaces are made of different kind materials.

After the parison 217 is prepared, it is pinched by moving the metal mold 218 from the position shown in FIG. 17, (b) to the position shown in FIG. 17, (c). Then, the air is injected through an air nozzle 219 as shown in FIG. 17, (c) to effect blow molding into a configuration of the metal mold 218. At this time, the inner shell and the casing are closely contacted without a space therebetween. It is preferable to control the temperature of the mold during the molding within the range of plus and minus 30° C. from a reference temperature, since then the variation in the thickness of each wall of the ink container can be decreased.

Figure 19:
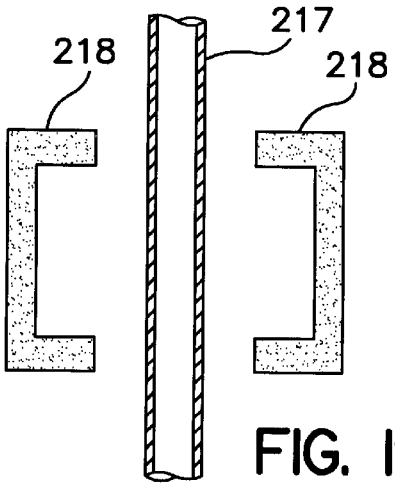
FIG. 19 ((a1), (a2), (b1), (b2), (c1), (c2)) is a schematic view showing a state of a liquid container in a manufacturing step of a liquid container according to an embodiment of the present invention.
Figure 19:
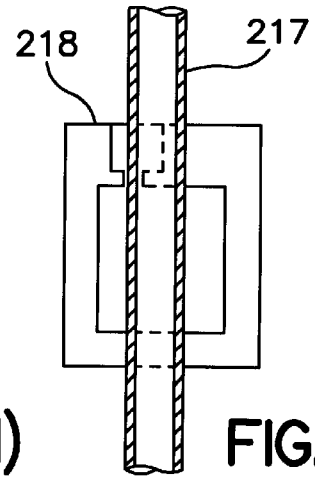
Figure 19:
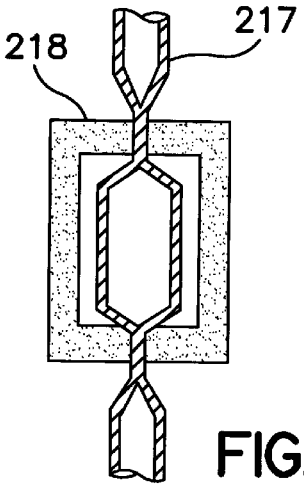
Figure 19:
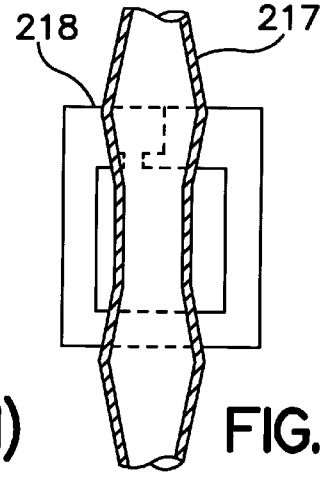
Figure 19:
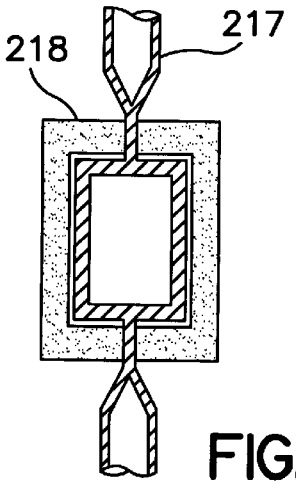
Figure 19:
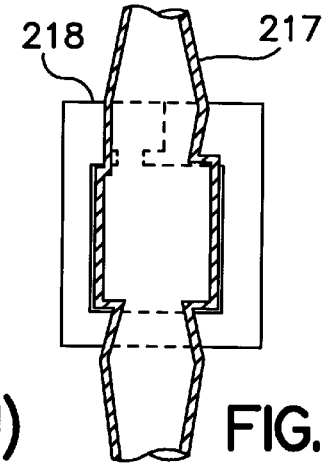

FIG. 19 is a schematic view showing a state of a liquid container in a manufacturing step of a liquid container according to an embodiment of the present invention, and is a side view of the mold shown in FIG. 17, (b)–(d). FIG. 19, (a1), (b1), (c1) is a view as seen in the mold-dividing direction, and (a2), (b2), (c2) are views as seen the orthogonal direction.

In FIG. 19, (a1), (a2) show the states before the parison is pinched by the mold, and (b1), (b2) show the state in which the parison is pinched by the mold. At this time, the circular parison is collapsed into a flat circle at a position where it is pinched by the mold, and therefore, it wider there than the other portion. The pinched portion remains as a pinch-off portion. FIG. 19, (c1), (c2) show a configuration after the parison is molded by the blowing air.

Thereafter, the container is separated from the mold, and the portion of the inner shell other than the ink supplying portion, is separated from the outer wall. As for the method of the separation, vacuum is usable, and in another method, the molding resin materials of the inner wall and the outer wall are of materials having different thermal expansion coefficients (shrinkage rates). In this case, by the lowering of the temperature of the resin materials after the blow molding, the separation is automatically effected so that number of steps in the manufacturing is reduced. The inner shell and the outer wall may be separated by applying external force after molding at a position where the parison has been pinched during the molding, by which a space in fluid communication with the ambient air, is provided therebetween and may be used as air vent. This is preferable since then the number of manufacturing steps can be reduced.

After the separation between the inner shell and the casing, the ink is injected. Before the ink injection, the ink accommodating portion may be expanded by compressed air to provide the same shape as in the initial stage of the container, and then the ink injection may be carried out. In addition, when the ink accommodating portion is expanded into the initial state shape, the ink may be injected by pressurization. At this time, the inner shell and the casing of the ink container is separable by discharge of the ink. After the ink is injected, a cap having the liquid discharge permission member 106 is mounted.

In the above-described blow molding, the parison 217 is processed while it still has a viscosity, and therefore, the inner wall resin material, outer wall resin material and the reinforcing member resin material do not acquire orientation property.

The employment of blow molding can reduce the number of manufacturing steps and the number of the components, which in turn can improve yield, and also allows the inner wall to be formed in such a manner that edges and corners of the inner wall are set in those of the outer wall in an orderly manner.

In other words, when the ink container is in the initial state, that is, the state immediately after the ink is injected in the ink container, the outer wall and the inner wall become similar in external configuration; therefore, the Inner wall snugly fits within the outer shell, holding a predetermined gap between them. As a result, a large dead space found in the conventional ink container comprising an outer shell and an ink containing pouch enclosed therein can be eliminated, increasing the amount of the ink retainable per unit volume of the outer shell (ink holding efficiency can be improved). Additionally, the separable casing and the inner shell have the similar structure since they are provided by uniformly expanding a cylindrical parison into a prism by air blow through the direct blow manufacturing method. More particularly, in the inner shell, the thickness of the wall of the container is thinner adjacent the corner portions than at the center portions. Similarly, the thickness of the casing is thinner adjacent the corner portions than at the center portions.

The inner shell is laminated to an outer wall having a thickness distribution of gradually decreasing thickness from the central portion toward the corner portions. As a result, the inner shell has an outer surface complementary with the inner surface of the outer wall. The outer surface of the inner shell follows despite the thickness distribution of the outer wall, and therefore, it is convex toward the liquid containing portion side formed by the inner walls. These structures particularly functions at the maximum area portion as described in the foregoing. Therefore, the convex configuration exists in the maximum area portion, and the height of the convex configuration in the surface of the inner wall may be not more than 2 mm, and may be not more than 1 mm at the outer surface of the inner wall. The convex configuration in the small surface area side of the container, may be within the measurement error, but the convexity there is preferable since it provides the priority of deformation in each surface.

The reinforcing member is formed by lamination between the outer wall and the inner wall or the ink accommodating portion side of the inner wall, so that in any case, the thickness distribution is, similarly to the outer wall, that thickness is large in the central portion and gradually decreases toward the marginal portion and that it is convex toward the liquid containing portion side of the inner wall. Therefore, the adjustment of the local strength can be easily accomplished without particular control relating to the thickness when the parison of the reinforcing member is supplied.

Figure 20:
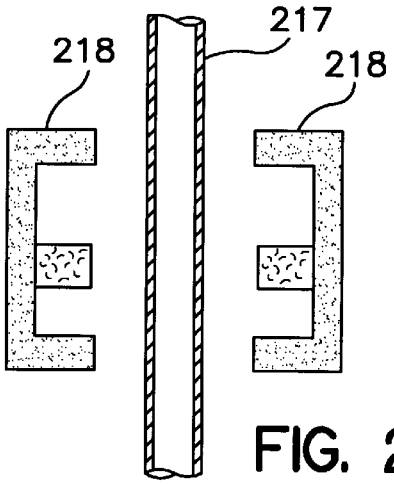
FIG. 20 ((a1), (a2), (b1), (b2), (c1), (c2)) is a schematic view showing a state of a liquid container in a manufacturing stop of a liquid container according to an embodiment of the present invention.
Figure 20:
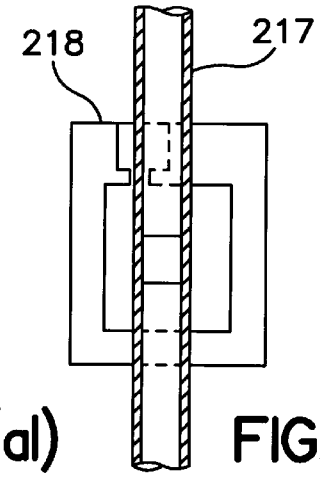
Figure 20:
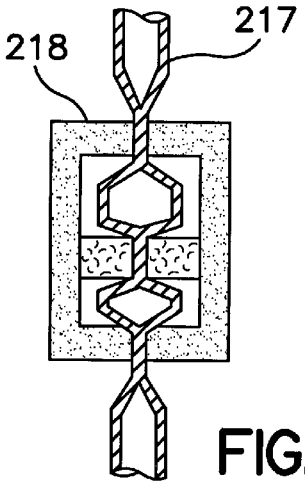
Figure 20:
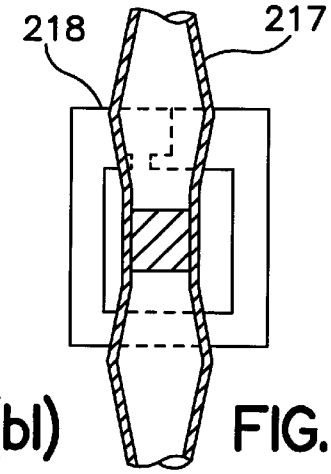
Figure 20:
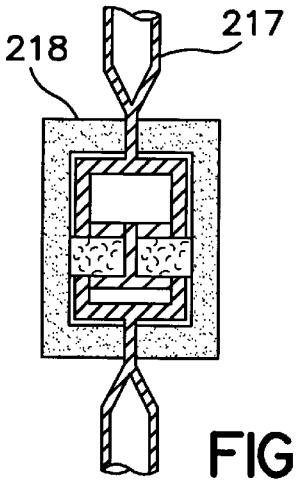
Figure 20:
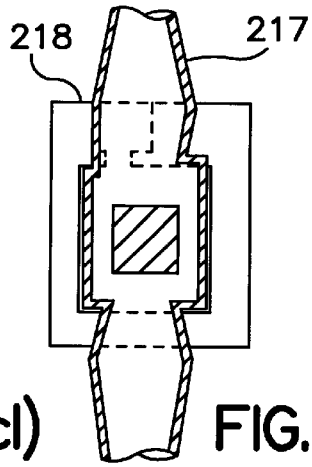

In the cases of the first to the third embodiment and eighth to the fourteenth embodiment, the configuration of the metal mold is modified. FIG. 20 shows an example of a relation between the metal mold and the parison in the case of the second embodiment. FIG. 20 shows a view of the mold used for the molding, as seen in the lateral direction, wherein (a1), (b1), (c1) are the views as seen in the direction of division of the molding, and (a2), (b2), (c2) are views as seen in the orthogonal direction. In FIG. 20, (a1), (a2) show the states before the parison is pinched by the mold, and (b1), (b2) show the state in which the parison is pinched by the mold. At this time, the circular parison is collapsed into a flat circle at a position where it is pinched by the mold, and therefore, it wider there than the other portion. The pinched portion remains as a pinch-off portion. FIG. 20, (c1), (c2) show a configuration after the parison is molded by the blowing air. The parison of the layer 217*a* for the casing and the layer 217*c* for the inner wall, are supplied continuously both in the direction of the supply and in the direction perpendicular thereto, and the layer 217*b* for the reinforcing member is not supplied.

As regards the crimping portion of the liquid container, the corresponding portion of the metal mold is made convex, and the parison is contacted to the portion opposing thereto by the projection.

As for the manufacturing of the liquid container according to the first–third embodiment, the description has been made as to the example wherein the metal mold is provided with a projection from the beginning. The portion may be made slidable, and is made convex in the step of air injection. When the through-hole is formed as in the first embodiment, it is desirable to provide a dimple at the central portion of the projection to provide an escape for the resin material in the through hole portion.

<Molding resin material>

The description will be made as to molding resin material of the ink container. The ink container of the present invention comprises an inner shell for accommodating the ink and an outer wall covering the inner wall (double wall structure). The inner shell of the fourth–seventh embodiments is provided with non-separable reinforcing members on the inner wall for constituting the ink accommodating portion.

Therefore, the material of the inner wall preferably has a flexibility when the thickness is small, has a high hydrophilicity and has a low permeability relative to gasses; and the material of the outer wall preferably has a high mechanical strength to protect the inner wall. The material of the reinforcing member preferably has a high welding property relative to the inner wall and has a high mechanical strength. More particularly, the material of the inner wall preferably has a stretching elastic modulus of 150–3000 (kgf/cm$^2$) approx.; the material of the reinforcing member preferably has a stretching elastic modulus larger than that of the material of the inner wall since then the thickness of the reinforcing member can be reduced. For example, the outer wall material is non-crystallinity material such as Noryl ((GE); and the inner wall material is crystal property material such as a low density polyethylene (LDPE); and the reinforcing member material is height density polyethylene (HDPE). In this case, the non-crystallinity resin material generally has a small heat contraction rate, and the crystal property resin material generally has a large heat contraction rate, and therefore, the release or separation property between the resin materials is improved. The LDPE and the RDPE exhibit high welding property between them, and the HDPE has a larger stretching elastic modulus than the LDPE so that thickness of the reinforcing member can be reduced.

Examples of the non-crystallinity material include polystyrene, polybarbonate and polyvinyl chloride. Examples of crystal property material include polypropylene, polyethylene, polyacetal, polyamide, which form crystal portion at a certain ratio under a predetermined ambience of crystallization. In addition to the use of the material having different heat contraction rate for the outer wall and the inner wall, a combination of non-polar properties and a combination of a non-polar resin material and the polar resin material to enhance the release property between the resin materials, are usable.

In the foregoing description, the outer wall, inner wall and reinforcing member have been described as having a monolayer structure, but one or more of them may have a multi-layer structure using different materials to enhance an anti-impact property. By the multi-layer structure of the outer wall, the damage possible during transportation or mounting can be avoided. When the material of the reinforcing member does not have the welding property relative to the inner wall, the reinforcing member may have a multi-layer structure, and the layer in contact with the inner wall may be a bonding layer inseparably integrated with the inner wall.

<Configuration of the air vent>

Figure 21A:
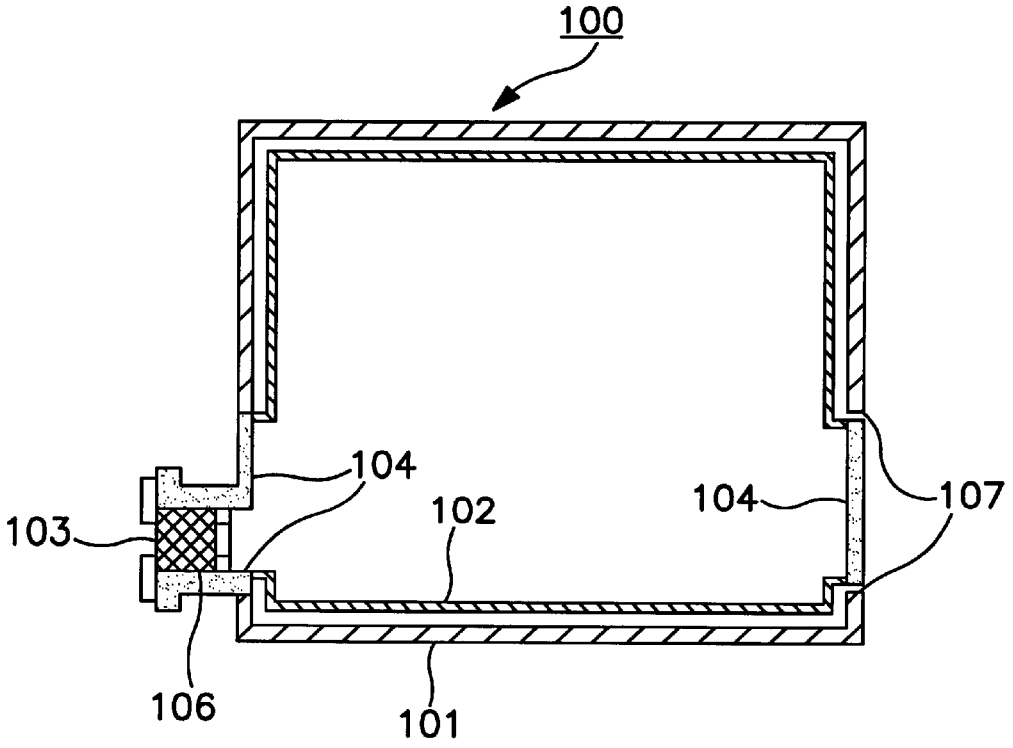
FIG. 21 is a schematic illustration of a liquid container according to a further embodiment of the present invention, wherein (a) is a sectional view, and (b) is a side view.
Figure 21B:
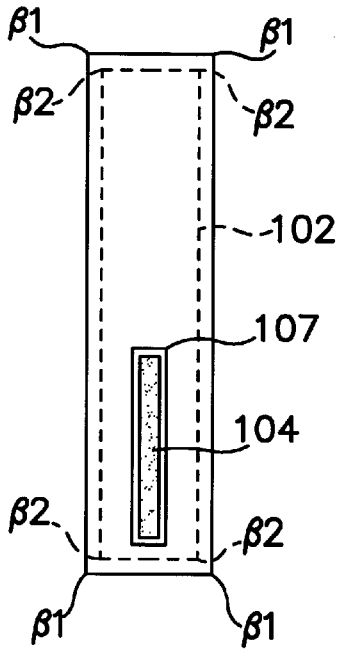
Figure 22A:
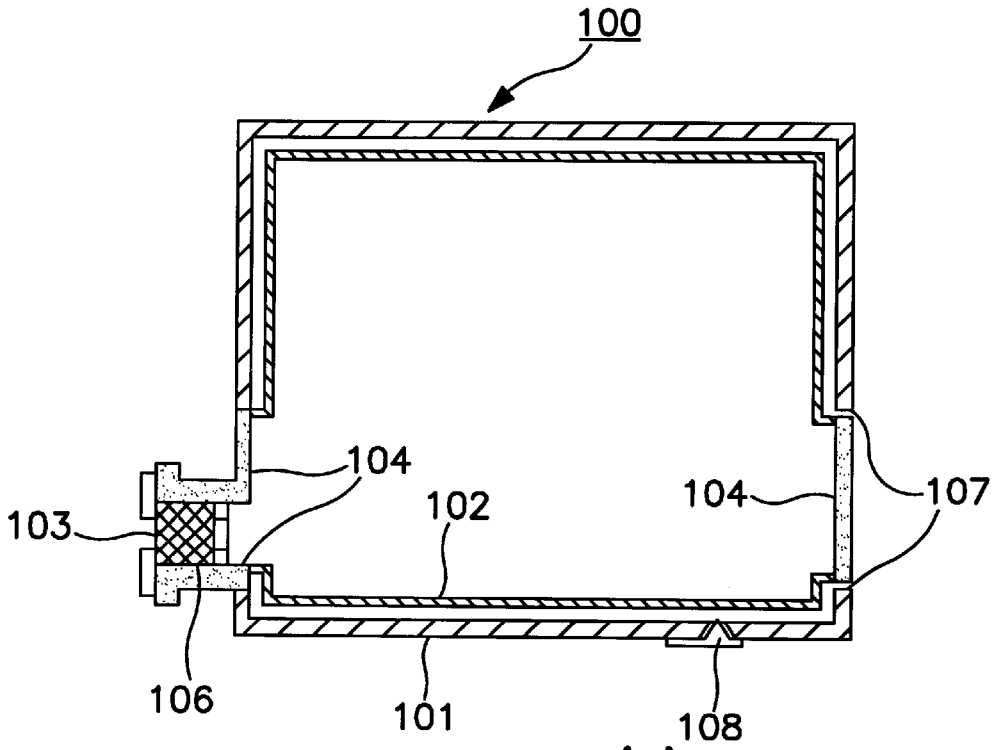
FIG. 22 is a schematic illustration of a liquid container according to a further embodiment of the present invention, wherein (a) is a sectional view, and (b) is a side view.
Figure 22B:
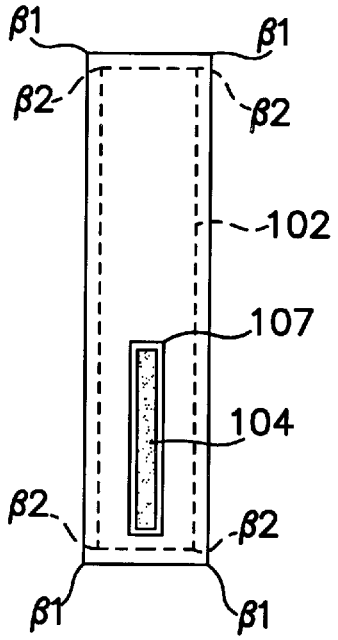

FIGS. 21 and 22 show examples of the air vent.

In the example shown in FIG. 21, the small gap 107 of approx. several tens pm between the outer wall and the inner wall formed adjacent the welded portion 104 is used as an air vent. By selecting, as a material of the inner wall 102, a material which exhibits low adhesiveness to the outer wall 101, the gap is provided by applying external force tot welded portion 104 to separate the inner wall 102 from the outer wall 101.

In FIG. 22, by using different materials for the outer wall 101 and the inner wall 102, residual stress may be used to separate the inner wall from the outer wall to provide the gap 107, similarly to the above example. A valve openable to the outside is provided in the outer wall of the liquid container to assist the pressure balance of the inner wall of the liquid container. In the normal supply of the ink, the air is introduced into the space between the inner wall 102 and the outer wall 101 through the gap, and this is enough for proper pressure adjustment. However, the provision of the valve is effective to quickly accommodate the sudden pressure change due to falling.

<Pinch-off portion>

Figure 23A:
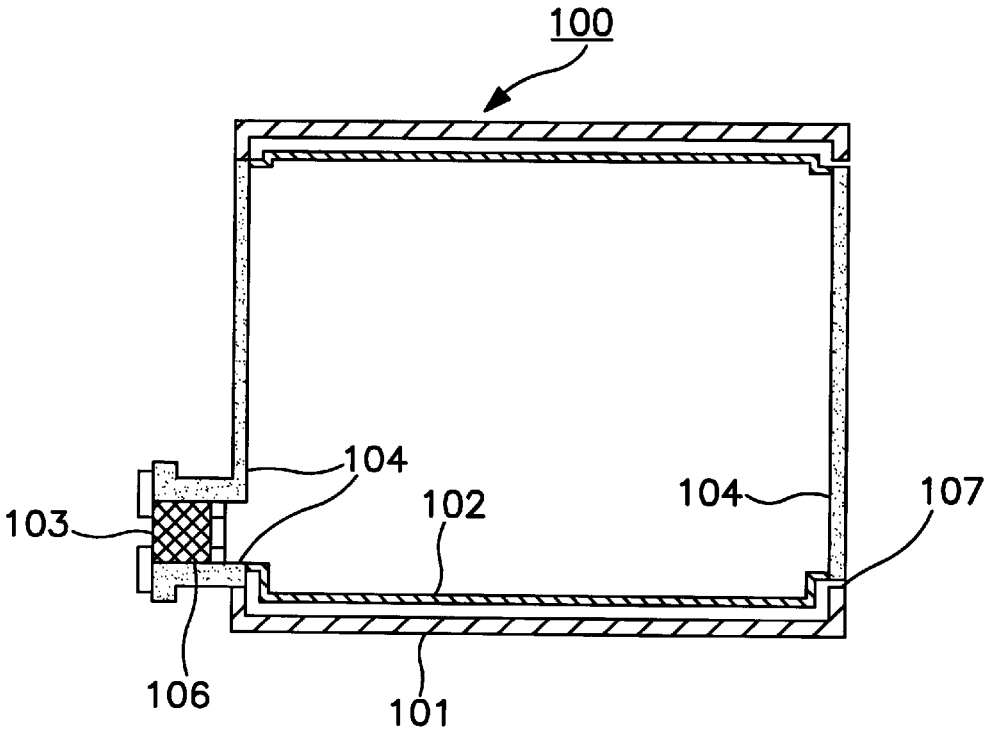
FIG. 23 is a schematic illustration of a liquid container according to a further embodiment of the present invention, wherein (a) is a sectional view, and (b) is a side view.
Figure 23B:
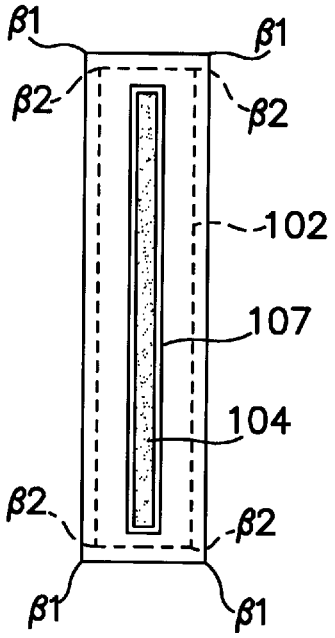

FIG. 23 is a schematic view of an ink container according to a further embodiment of the present invention. FIG. 23, (a) is a sectional view, and (b) is a side view. The diameter of the parison is larger than the foregoing embodiment, so that it covers substantially the total width of the container.

The description will be made as to the portions different from the foregoing embodiments.

In the ink container shown In FIG. 23, (a), 104 is formed over substantially the entirety of the height of the ink container 100.

In the manufacturing method, when the first, and second parisons are extruded by the extruder (FIG. 17), the diameter of the parison is substantially the same as the diameter of the metal mold 218, by which the degree of expansion by the air injection is small. By reducing the expansion of the parison, the distance from the parison to the corner portion of the ink container can be substantially reduced. By this, the thicknesses of the corner portions can be uniform, thus proving equal strength corners.

In this embodiment, the pinch-off portion is provided over substantially the entire width of the side surface of the container, by which the inner wall is more stably supported, and therefore, the negative pressure of the discharged ink is stabilized. The pinch-off portion is widely formed at opposite positions, so that mechanical strength of the ink container is enhanced against the external impact.

In this embodiment, the configuration of the ink container is not limiting, but the symmetrical configuration as in the embodiment is preferable since then the pinch-off portion is provided on the opposing position from a side adjacent to the surface having the maximum area of the ink container, by which the negative pressure production is stabilized. More particularly, the deformation of the inner wall is supported at the positions faced to each other with e maximum areas therebetween, by which the deformation of the maximum surface side upon the ink discharge can be regulated. Together with the deformation confinement at the corner portions described in the foregoing, the negative pressure production is further stabilized.

<Configuration of the corner portion>

Figure 24A:
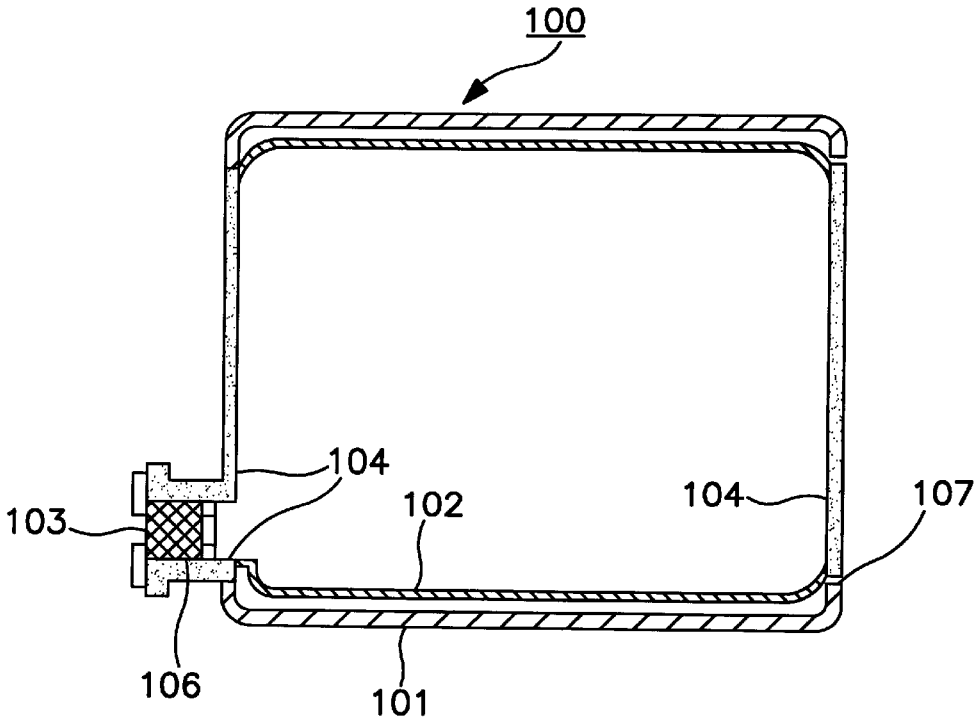
FIG. 24 is a schematic illustration of a liquid container according to a further embodiment of the present invention, wherein (a) is a sectional view, and (b) is a side view.
Figure 24B:
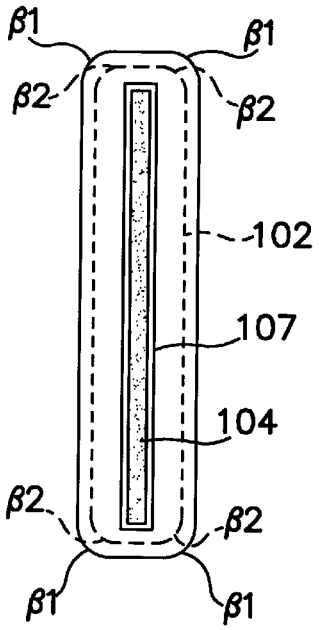

FIG. 24 is a schematic view of an ink container according to a further embodiment of the present invention. FIG. 24, (a) is a sectional view, and (b) is a side view.

In this embodiment, the corner portions and the crossing portions between adjacent sides are rounded (small curved surface configuration), as contrasted to the foregoing embodiment.

By such rounding, the thin corner portions and the thin crossing portions can be formed stably when the parison is expanded to the metal mold. Additionally, occurrence of pin holes can be minimized by employing the small curved surface in the corner portion and the crossing portion in this manner. The provision of the small curved surface is further effective to form the outer wall and the inner wall with substantially uniform film thickness, thus permitting stabilized movement of the surface, as compared with the case of edge corner structure. By the uniformation of the film thickness there, the strength can be stabilized. The curved surface configuration is effective to enhance the strength of the portions, thus avoiding the local collapse there. Thus, the regulation of the collapse is stably accomplished.

In the manufacturing method of the container of this embodiment, the portions of the metal mold 218 (FIG. 17) corresponding to the corner portions and the crossing portions, is rounded.

In this case, the manufacturing of the metal mold is easier, so that productivity is improved, and therefore, the manufacturing of the ink container is substantially inexpensive.

The configuration of the ink container is not limited to the disclosed example, but the configuration of the foregoing embodiments or a single wall container is usable with the rounded corner.

Figure 25A:
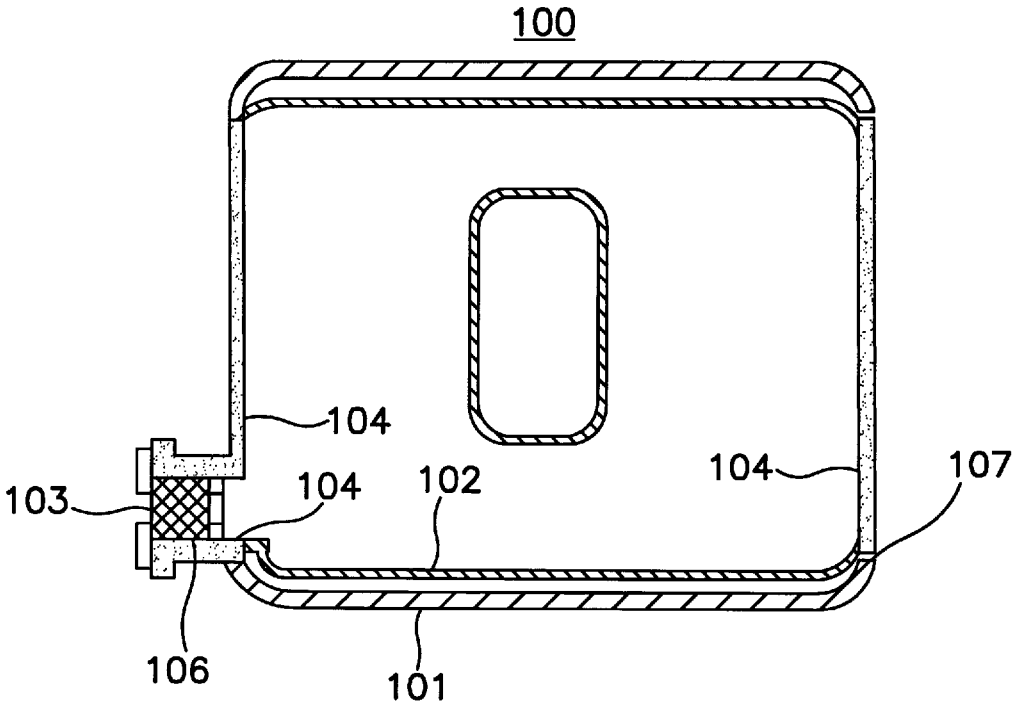
FIG. 25 is a schematic illustration of a liquid container according to a further embodiment of the present invention, wherein (a) is a sectional view, and (b) is a side view.
Figure 25B:
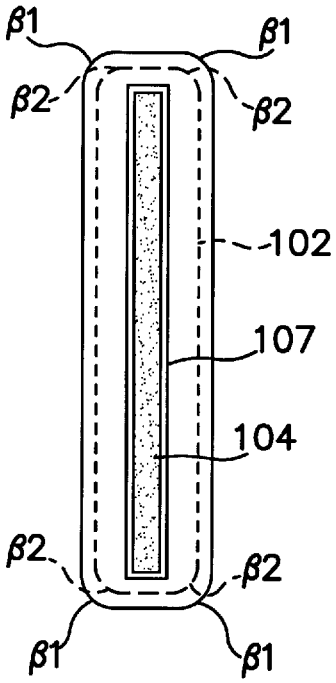

When this embodiment is incorporated in the first–third embodiments, the crossing portions between the sides may be rounded, including the through-hole portion, or the rounding may not be used for the through-hole portion. FIG. 25 shows an example wherein the crossing portion between the adjacent sides are rounded (small curved surface configuration) including the portion forming the central through-hole. In FIG. 25, (a) is a sectional view, and (b) is a side view.

<Container configuration>

Other embodiments of the containers according to present invention will be described.

Figure 26A:
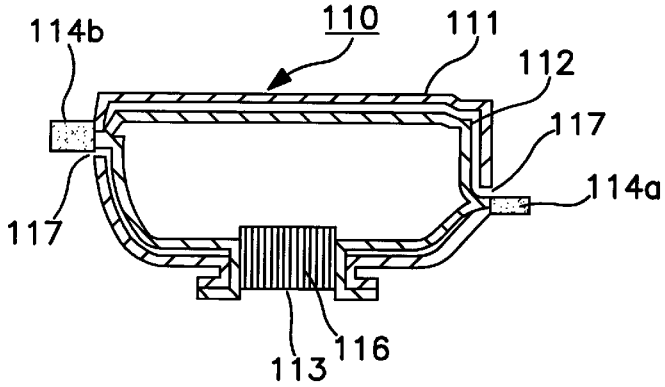
FIG. 26 is a schematic illustration of a liquid container according to a further embodiment of the present invention, wherein (a) is a sectional view, (b) is a plan view, and (c) is a perspective view where bottom is at the top.
Figure 26B:
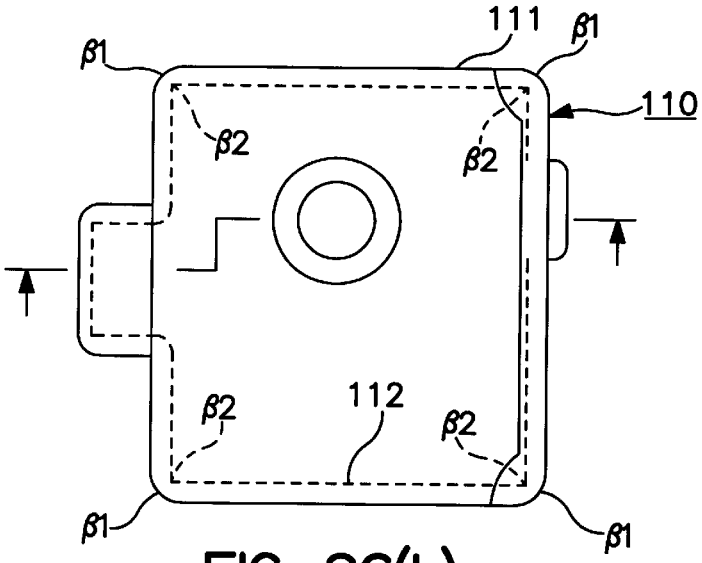
Figure 26C:
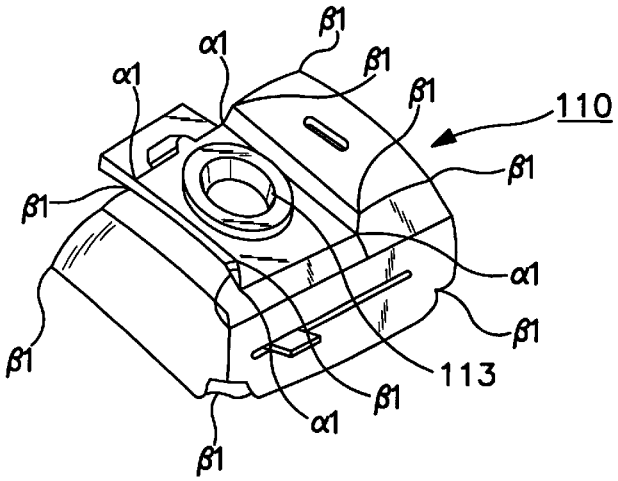

FIG. 26 is a schematic view of an ink container according to a further embodiment of the present invention. In this embodiment, the configuration of the container and the positional relation between the ink supplying portion and the inner wall supporting portion, are different from the foregoing embodiments.

The ink container has a double wall structure to prevent ink evaporation, to make the pressure in the container uniform and to prevent the leakage of the ink, and the inner wall follows the variation of the internal pressure due to the decrease of the ink, similarly to the foregoing embodiments. At least one of the corner portions a of the side having the ink supplying portion, has three 90 degree angles, so that corner functions as an auxiliary confining portion for the inner wall. In this embodiment, the configuration of the ink container 110 is closer to a cubic member than in the other embodiments, and the ink supplying portion 113 is provided in the bottom surface. The surface having the ink supplying portion 113 and the surface having the welded portion 114 are not opposed to each other, and the gap 117 formed adjacent the welded portion is used as air vent.

At least one of the outer wall surfaces of the maximum surface area sides of the outer walls which are substantially flat, does not have a portion connected with the inner wall 112, so that inner wall is easily separable from the outer wall, similarly to the first embodiment. In this embodiment, the same applies to the side opposite therefrom, and an ink supplying portion 113 is provided on that side.

When the inner wall 112 deforms due to the use of the ink from the ink accommodating portion of the ink container of this embodiment, the deformation starts at the ceiling surface in place of the simultaneous deformation of the opposed sides. The direction of the deformation is downward in the vertical direction, and is codirectional with the supply direction of the ink toward the recording head from the ink supplying portion. Accordingly, in this embodiment too, the ink ejection and negative pressure maintenance can be easily accomplished to the similar extent as in the foregoing embodiments.

This ink container is manufactured through the blow molding method as in the foregoing embodiments. However, the relation between the parison supply direction and the position of the ink supplying portion 113 is different, and therefore, additional steps for the welding of the air introduction port and the provision of the ink supplying portion port, are required. The air inlet port may be provided at either of welded portions 114*a*, 114*b*. In this embodiment, the welded portion 114*b* is used for the air inlet, and after the molding the inner wall is welded at 114*b*.

This is because when the ink supplying portion is in the parison supply direction, the use of said additional steps easier than providing the maximum surface area sides in the direction having the welded portion, that is, in the direction perpendicular to the parison supply direction.

When the pinch-off portions are provided in the maximum area sides as in first–third embodiments, it is desirable to provide the pinch-off portion of the maximum area side at a position remote from the ink supplying portion, in this embodiment.

<Structure of outer wall>

Figure 27A:
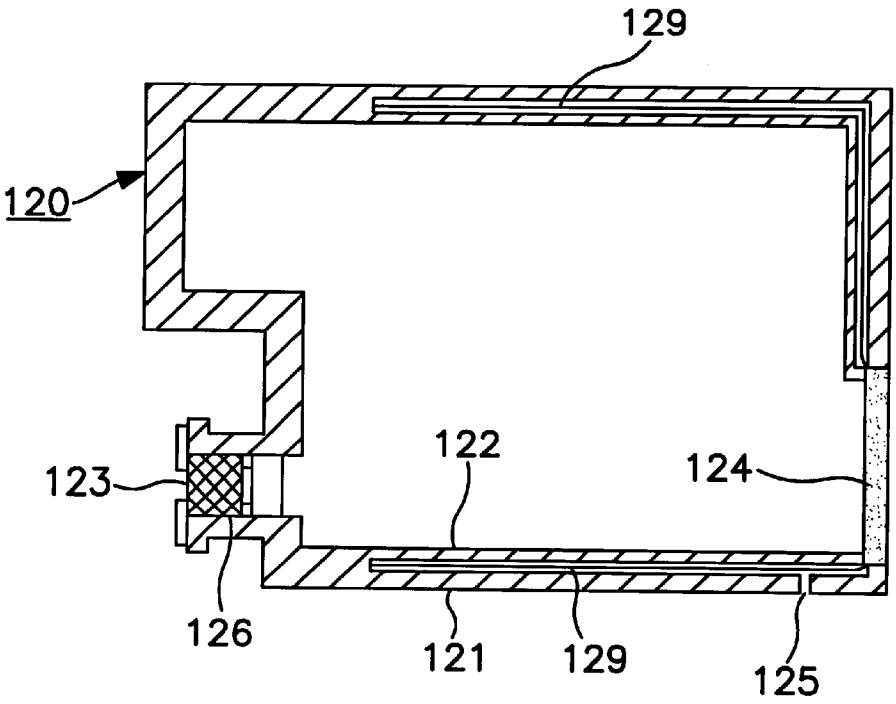
FIG. 27 is a schematic illustration of a liquid container according to a further embodiment of the present invention, wherein (a) is a sectional view, and (b) is a side view.
Figure 27B:
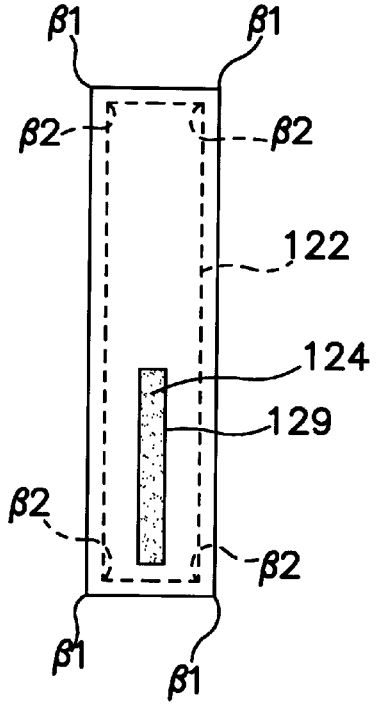

FIG. 27 is a schematic view of a structure of an ink container according to another embodiment. In FIG. 27, (a) is a sectional view, and (b) is a bottom view. In this embodiment, a separation layer is formed between the inner wall and the outer wall. The ink container 120 shown in FIG. 27, (a) comprises an outer wall 121 and an inner wall 122.

Between the outer wall 121 and the inner wall 122, there is a partial separation layer 129, but at the other part, they are integral, and are constituted by the same materials although the thickness is different. The separation layer 129 is made of a material not having an adhesiveness relative to the inner wall 122 and the outer wall 121, and therefore, the inner wall and the outer wall are easily separated. It will suffice if the separation layer 129 and the outer wall 121 and the inner wall 122 are separable, and even if the separation layer and the outer wall and the inner wall may be contacted, or may be space apart with a small gap. In any case, only the portion between the separation layer 129 and the outer wall 121, is in fluid communication with the outside through the air vent 125 formed in the outer wall 121. The inner wall 122 and the separation layer 129 may be made unification.

Accordingly, when the ink in the ink container is consumed, the inner wall 122 deforms, and therefore, the volume of the region enclosed by the inner wall decreases, so that inner wall receives the force toward the original position due to the elasticity. The separation layer is thinner than the inner wall, and therefore, it is deformed simultaneously the deformation of the inner wall. The ambience is introduced into between the separation layer 127 and the outer wall through the air vent 125. The introduced ambience assists the deformation of the inner wall to maintain a stable negative pressure during use of the ink.

Designated by 123 is an ink supplying portion for supplying the ink out of the inside of the container, and functions as connecting portion with an ink introduction portion of an unshown ink jet head. Designated by 126 is an ink discharge permission member which is a connecting portion with the ink jet head.

In the neighborhood of the ink supplying portion 123, the outer wall 121 and the inner wall 122 are integral, the moldability of the ink supplying portion 123 can be easily improved in the manufacturing step using the blow molding. The better moldability of the ink supplying portion 123 leads to the assured connection with the ink jet recording head, so that ink leakage at the connecting portion can be prevented. This is particularly desirable when the ink container is repeatedly mounted to and demounted from the ink jet recording head. Additionally, since the outer wall and the inner wall are integrally molded adjacent to the ink supplying portion 123, the strength in the neighborhood of the ink supplying portion 123 can be enhanced.

Designated by 124 is an inner wall welded portion where the inner wall 122 is engaged to the outer wall 121 through the separation layer 129 sandwiched therebetween, it supports the inner wall 122 by engagement with the outer wall. The manufacturing method is similar to the foregoing except for additional layer of parison is used.

The structure of the outer wall will be described. One of the functions of the outer wall is to regulate the deformation of the corner portions of the inner wall. To do this function, the outer wall will suffice if it can maintain the configuration of the corners against the deformation of the inner wall and if it covers the corner portions (corner portion enclosing member). The outer wall or the inner wall may be covered by a material such as plastic resin material, metal or thick paper, or the like. The outer wall may cover the entire inner wall, or it may be plates covering only the corner portions and connected with each other by metal members. The outer wall may have a mesh structure.

<Ink jet cartridge>

Figure 28A:
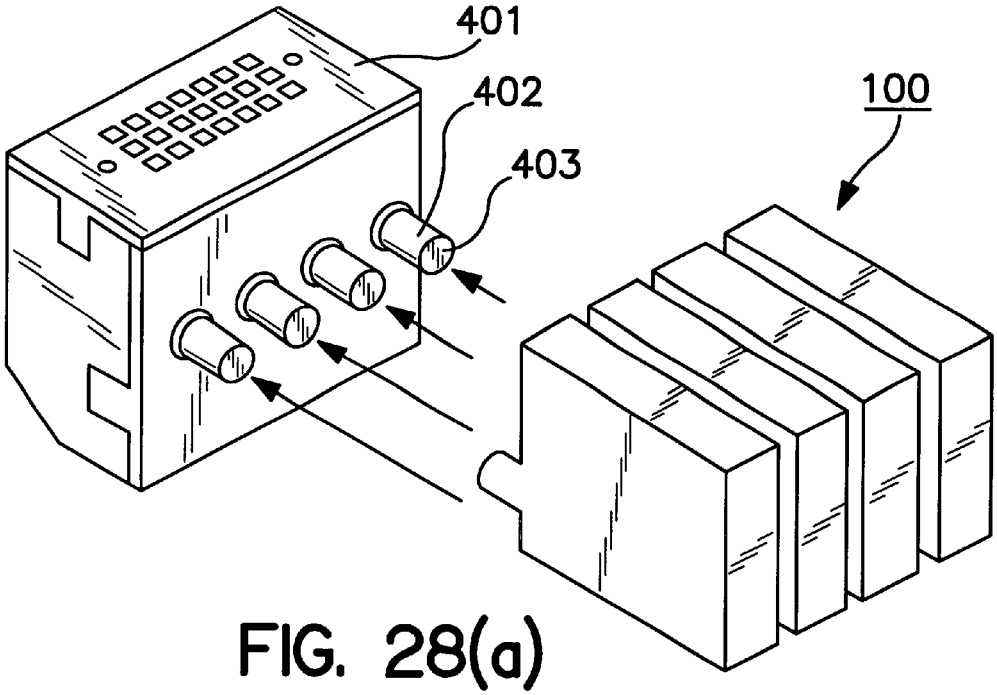
FIG. 28, (a) is a perspective view of a liquid container and a recording head connectable thereto, (b) is a sectional view showing the liquid. container and the recording head connected to each other.
Figure 28B:
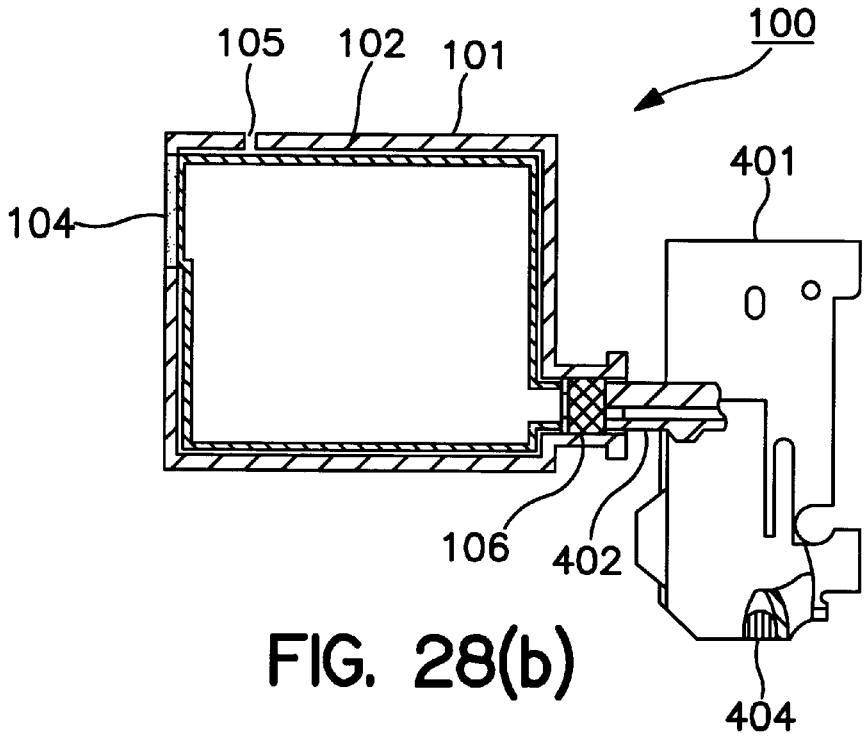

The description will be made as to connection oft ink container of this invention to the recording head. FIG. 28, (a) is a schematic view of a recording head as a recording means connectable with the ink container of the present invention, and FIG. 28, (b) is a schematic sectional view when the recording head and the ink container are connected with each other.

In FIG. 28, (a), designated by 401 is a recording head unit as the recording means, and integrally includes black, yellow, cyan and magenta recording heads to permit full-color printing. The recording head each has a liquid flow path including an ejection outlet for ejecting the ink and a heat generating resistor for ejecting the ink through the ejection outlet.

Designated by 402 is an ink supply tube as an ink introduction portion for introducing the ink to the respective recording heads, and an end of the ink supply tube 402 is provided with a filter 403 for trapping bubbles or foreign matters. When the ink container 100 is mounted to the recording head unit 401, the ink supply tube 402 is connected to the press-contact member 106 provided in the ink container 100, as shown in FIG. 28, (b), so that ink supplyable state is established.

After the ink container mounting, the ink is introduced into the recording head from the ink container to establish the ink communication state. Thereafter, during printing operation, the ink is ejected from the ink ejection portion 404 provided in the recording head so that ink in the ink container inner wall 102 is consumed.

The ink container of the present invention is provided with the ink supplying portion at a portion below the center of the ink container. Therefore, there is no need of adjustment of the ejection power at the recording head side in response to the change of the remaining amount of the ink, and the usage efficiency of the ink can be improved. Inner shell of the ink container of the embodiments of the present invention, itself has an negative pressure production and maintaining function, and therefore, what is required to the ink discharge permission member such as a press-contact member, valve, rubber plug, is to retain the ink when the container is separated from the recording head.

<Ink jet recording apparatus>

Figure 29:
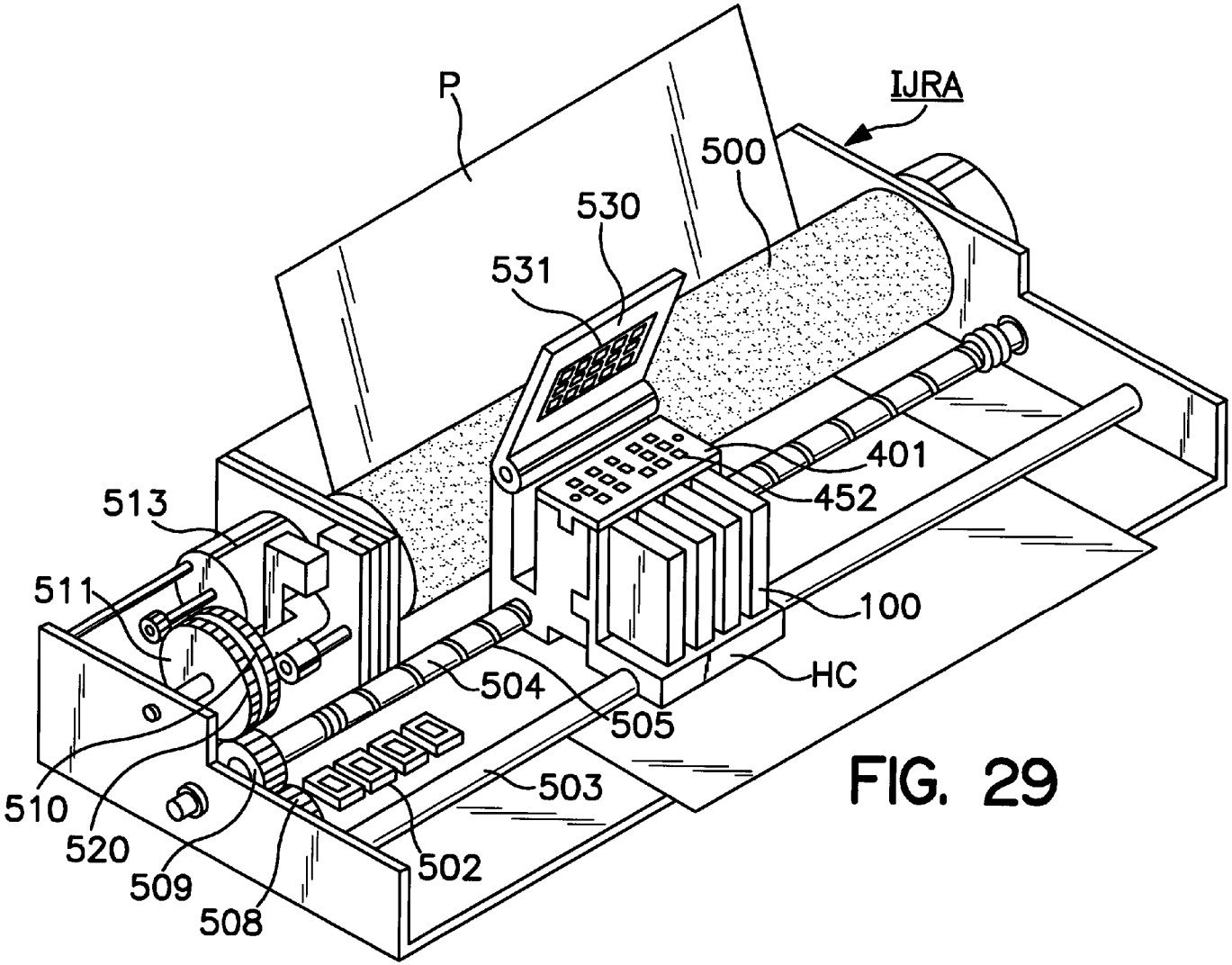
FIG. 29 is a schematic illustration of an ink jet recording apparatus using a liquid container according to an embodiment of the present invention.

The description will be made as to an ink jet recording apparatus using the ink container according to the embodiments of the present invention. FIG. 29 is a schematic view of an ink jet recording apparatus which is compatible with the ink containers described in the embodiments of the present invention.

In FIG. 29, the head unit 401 and the ink container 100 are securely but removably mounted on the carriage provided on the main assembly side of the ink jet recording apparatus, with the use of an unillustrated positioning means.

The forward and backward rotation of a driving motor 513 is transmitted to a lead screw 504 through driving force transmission gears 511 and 509, rotating the lead screw 504. The lead screw 504 is provided with a helical groove which engages with an unillustrated pin provided on the carriage. With this arrangement, the carriage is reciprocally moved in the e longitudinal direction of the apparatus. Designated by 502 is a cap for caping a front side of each recording head in the recording head unit to assist operation of a suction recovery for the recording head through an opening in the cap, using an unshown suction means. The cap 502 is moved by the driving force transmitted through a gear 508 and the like, being enabled to cover the ejection surface of each recording head. Adjacent to the cap 502, an unillustrated cleaning blade is disposed so as to be movable in the vertical direction of this drawing. The configuration of the blade is not limited to the form depicted in the drawing, and needless to say, any known cleaning blade is compatible with the present invention.

The apparatus is structured so that appropriate operation among the capping, cleaning, and performance recovery sucking operations is performed at a pertinent position by the function of the lead screw 505 when the carriage is at its home position, it is also needless to say that any structure is compatible with the present invention as long as the structure can enable a proper operation to be performed with known timing.

When the recording head unit is mounted on the carriage, the connection pad 452 of the recording head unit is connected to the connection pad 531 of a connection plate 530 provided on the carriage, whereby electrical connection is established. This connection occurs as the connection pad 530 is rotated about its axis. No connector is used for the connection, and therefore, no additional force is applied to the recording head. In the foregoing, the description has been made as to an ink container usable in the ink jet recording field, but the present invention is applicable to a pen or another ink ejection portion (recording station) for supplying the ink to the outside under the negative pressure. In this case, the liquid supply portion corresponding to the ink supplying portion of the ink container may be provided with a liquid discharge prevention member which is an ink discharge permission member in the ink container.

The liquid container of the present invention is applicable to the ink jet recording apparatus wherein the recording is effected by ejecting the ink, food machines for serving to supply the various sources, condiment or the like, since various liquids can be contained irrespective of the viscosity or thermal property.

While the invention has been described with reference to the structures disclosed herein, it is not confined to the details set forth and this application is intended to cover such modifications or changes as may come within the purposes of the improvements or the scope of the following claims.

What is claimed is:

1. A liquid container for containing liquid for ink jet recording and for supplying the liquid to outside with a negative pressure, comprising:

a generally prism-like casing having a substantial air vent and having a corner portion formed by extensions of three sides of the prism-like casing;

an inner shell for containing liquid therein, said inner shell having outside equivalent or similar to inside of said casing;

a liquid supply portion for supplying the liquid from said inner shell to an outside thereof for ink jet recording;

a pinch-off portion where said inner shell is pinched by said casing;

wherein said casing and said inner shell have respective substantially flat maximum area sides which do not have said liquid supply portion or said pinch-off portion; and a deformation confinement member provided on said maximum area side of said inner shell except for a marginal portion thereof.

2. A liquid container according to claim 1, wherein said deformation confinement member is an integral portion where a maximum area side of said inner shell is integral with a side of said inner shell opposite therefrom.

3. A container according to claim 2, wherein said inner shell has a substantially donut-like configuration.

4. An ink jet cartridge comprising a liquid container as defined in claim 1 and an ink jet head for ejecting ink, connected to said liquid supply portion of said inner shell.

5. A container according to claim 1, wherein outer sides of said maximum area sides which are opposite from each other are separable from said casing, and each of said maximum area side has said deformation confinement member.

6. A container according to claim 5, wherein said deformation confinement member is in the form of projections which are provided on said casing and said inner shell and which are opposed from each other.

7. A container according to claim 5, wherein said deformation confinement member is in the form of projections which are provided on said casing and said inner shell which are different in configurations from each other.

8. A container according to claim 1, wherein a plurality of deformation confinement members are provided.

9. A container according to claim 8, wherein at least one of said deformation confinement members is provided at the central portion of said maximum area side.

10. A container according to claim 1, wherein said deformation confinement member has a thickness which is smaller adjacent the corner portion than adjacent the center portion of said maximum area side.

11. A container according to claim 1, wherein said inner shell has a thickness which is smaller adjacent the corner portion than adjacent a center portion of each side of the prism-like casing.

12. A container according to claim 1, wherein the corner portion of said inner shell and said casing are rounded.

13. A container according to claim 1, wherein said liquid supply portion is provided with a liquid discharge permission member for preventing leakage of the liquid.

14. A liquid container according to claim 1, wherein said deformation confinement member is of a material different from a material of said inner shell.

15. A liquid container according to claim 1, wherein deformation confinement area is in the form of projections which are provided on said casing and said inner shell.

16. A container according to claim 15, wherein said projection is in the form of parallel ribs extending in the longitudinal direction of said maximum area side.

17. A container according to claim 15, wherein said ribs have widths which is larger in a central portion of said maximum area side than in the corner portion.

18. A container according to claim 1, further comprising a separation layer partly provided between said inner shell and said casing to prevent said inner shell from contacting an ambience and said air vent is between the separation layer and said casing.

19. A liquid container for containing liquid for ink let recording and for supplying the liquid to outside with a negative pressure, comprising:

a generally prism-like liquid containing member for containing liquid therein, said liquid containing member having a substantial air vent and having a corner portion formed by extensions of three sides of the liquid containing member;

a corner portion enclosing member for regulating movement of a corner portion of said liquid containing member within a range in which a configuration of the corner portion is maintained when said liquid containing member is deformed; and a liquid supply port for supplying to an outside the liquid from said liquid containing member to an outside thereof for ink jet recording;

wherein said liquid containing member has a maximum area side which does not have said liquid supply port, and has a deformation confinement member on said maximum area side except for a marginal portion thereof.

* * * * *

UNITED STATES PATENT AND TRADEMARK OFFICE

CERTIFICATE OF CORRECTION

PATENT NO. : 6,305,794 B1
DATED : October 23, 2001
INVENTOR(S) : Toshiaki Sasaki et al.

It is certified that error appears in the above-identified patent and that said Letters Patent is hereby corrected as shown below:

Title page,
Item [30], Foreign Application Priority Data, "8-20446" should read -- 8-204646 --.

Column 1,
Line 9, "use" should read -- uses --;
Line 41, "is" should read -- are --; and
"does" should read -- do --; and
Line 42, "for the" should be deleted.

Column 2,
Line 5, "In" should read -- in --.

Column 6,
Line 21, "a" should read -- α --;
Line 25, "is" should read -- are --; and
Line 31, "ot" should read -- of --.

Column 13,
Line 32, "In" should read -- in --.

Column 15,
Line 32, "is" should read -- are --;
Lines 34 and 38, "decreases" should read -- decrease --.

Column 16,
Line 7, "redioscopically." should read -- radioscopically. -- and
Line 30, "does" should read -- do --;
and "is" should read -- are --.

Column 19,
Line 56, "Inner" should read -- inner --.

Column 20,
Line 26, "similarly" should read -- similar --.

Column 21,
Line 24, "((GE);" should read -- (GE); --; and
Line 65, "tot" should read -- to the --.

UNITED STATES PATENT AND TRADEMARK OFFICE

CERTIFICATE OF CORRECTION

PATENT NO. : 6,305,794 B1
DATED : October 23, 2001
INVENTOR(S) : Toshiaki Sasaki et al.

It is certified that error appears in the above-identified patent and that said Letters Patent is hereby corrected as shown below:

Column 25,
Line 24, “oft” should read -- of the --;
Line 42, “matters.” should read -- matter. --; and
Line 60, “an” should read -- a --.

Column 26,
Line 14, “e” should read be deleted.

Column 27,
Line 23, “claim 1” should read -- claim 2, --; and
Line 27, “side” should read -- sides --.

Column 28,
Line 18, “is” should read -- are --; and
Line 25, “let” should read -- jet --.

Signed and Sealed this

Twenty-fifth Day of June, 2002

*Attest:*

*Attesting Officer*

JAMES E. ROGAN
*Director of the United States Patent and Trademark Office*